US007613419B2

(12) United States Patent
Suzuki et al.

(10) Patent No.: US 7,613,419 B2
(45) Date of Patent: Nov. 3, 2009

(54) IMAGE FORMING APPARATUS AND IMAGE FORMING METHOD CHARACTERIZED BY A PARTICULAR NIP TIME

(75) Inventors: Kazumi Suzuki, Shizuoka (JP); Takashi Fujita, Yokohama (JP); Hideki Kosugi, Sagamihara (JP); Ichiro Kadota, Tokyo (JP); Atsushi Nakafuji, Tokyo (JP); Hiromitsu Takagaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 466 days.

(21) Appl. No.: 11/511,380

(22) Filed: Aug. 29, 2006

(65) Prior Publication Data

US 2007/0071511 A1 Mar. 29, 2007

(30) Foreign Application Priority Data

Aug. 30, 2005 (JP) ..... 2005-248650
May 25, 2006 (JP) ..... 2006-145364

(51) Int. Cl.
*G03G 15/16* (2006.01)

(52) U.S. Cl. ..... 399/307

(58) Field of Classification Search ..... 399/307
See application file for complete search history.

(56) References Cited

U.S. PATENT DOCUMENTS 7,010,257 B2 3/2006 Someya et al.
7,031,648 B2 4/2006 Takashi et al.
7,269,384 B2 * 9/2007 Someya et al. ..... 399/307
2005/0025534 A1 2/2005 Fujita et al.
2005/0201783 A1 9/2005 Kurotaka et al.
2005/0207801 A1 9/2005 Kunii et al.

(Continued)

FOREIGN PATENT DOCUMENTS

JP 10-207256 8/1998

(Continued)

OTHER PUBLICATIONS

U.S. Appl. No. 12/042,143, filed Mar. 4, 2008, Kayahara, et al.

(Continued)

*Primary Examiner*—William J Royer
(74) *Attorney, Agent, or Firm*—Oblon, Spivak, McClelland, Maier & Neustadt, L.L.P.

(57) ABSTRACT

An image forming apparatus equipped with an image bearing member, a latent electrostatic image forming unit which forms a latent electrostatic image on the image bearing member, a developing unit which develops the latent electrostatic image by using a toner to form a toner image, a transfer fixing member which is roll shaped or belt shaped and bears the toner image , a heating unit which heats the toner image on the transfer fixing member; and a pressurizing member which is roll shaped and forms a transfer fixing nip with the transfer fixing member. The toner image on the transfer fixing member is transferred and fixed simultaneously to a recording medium which passes through the transfer fixing nip to record an image on the recording medium. At this time, the nip time, the time it takes for the recording medium to pass through the transfer fixing nip is set at 30 ms or less, the toner contains at least a binder, the binder has a main peak in an area of 5,000 to 15,000 molecular weight in a molecular weight distribution measured by GPC, the component of 30,000 or more molecular weight is 0.05% or less and a value of weight-average molecular weight (Mw) / number average molecular weight (Mn), Mw/Mn is 2 to 6.

19 Claims, 6 Drawing Sheets

U.S. PATENT DOCUMENTS

| | | | |
|---|---|---|---|
| 2005/0286920 | A1 | 12/2005 | Baba et al. |
| 2006/0008302 | A1 | 1/2006 | Someya et al. |
| 2006/0013624 | A1 | 1/2006 | Kurotaka et al. |
| 2006/0088349 | A1 | 4/2006 | Someya et al. |
| 2006/0120776 | A1 | 6/2006 | Takashi et al. |
| 2006/0140689 | A1 | 6/2006 | Echigo et al. |

FOREIGN PATENT DOCUMENTS

| | | |
|---|---|---|
| JP | 3021352 | 1/2000 |
| JP | 3042414 | 3/2000 |
| JP | 2003-167382 | 6/2003 |
| JP | 2004-145260 | 5/2004 |
| JP | 2004-246345 | 9/2004 |
| JP | 2004-302458 | 10/2004 |
| JP | 2005-10595 | 1/2005 |
| JP | 2005-115347 | 4/2005 |
| JP | 2005-148719 | 6/2005 |

OTHER PUBLICATIONS

U.S. Appl. No. 11/757,150, filed Jun. 1, 2007, Seto et al.
U.S. Appl. No. 12/164,921, filed Jun. 30, 2008, Suzuki et al.
U.S. Appl. No. 12/144,078, filed Jun. 23, 2008, Kayahara et al.

* cited by examiner

Example of Data Measured by GPC

IMAGE FORMING APPARATUS AND IMAGE FORMING METHOD CHARACTERIZED BY A PARTICULAR NIP TIME

BACKGROUND OF THE INVENTION

1. Field of the Invention

The present invention relates to an image forming apparatus and an image forming method of monochrome or color, typified by copiers, printers, facsimile or complex machines thereof, which includes a transfer fixing member which bears transferred toner images, a heating unit which heats the toner image on the transfer fixing member and a pressurizing member which forms a transfer fixing nip with the transfer fixing member, and by which the toner image on the transfer fixing member is transferred and fixed simultaneously to a recording medium such as paper passing through the transfer fixing nip to record the image on the recording medium.

2. Description of the Related Art

Image forming apparatuses in which images are formed on image bearing members by means of developing units, the images on the image bearing members are transferred primarily to intermediate transfer members by means of primary transfer units, the images on the intermediate transfer members are further transferred secondarily to recording media by means of secondary transfer units and the images on the recording media are then fixed have been widely known. The image forming apparatuses which perform entire processes step by step currently predominate the market, however, image forming apparatuses which perform transferring and fixing steps simultaneously, that is, having a transfer fixing step such as the ones disclosed in Japanese Patent (JP-B) No. 3042414 or Japanese Patent Application Laid-Open (JP-A) No. 2004-145260 are also known.

In JP-B No. 3042414, a method for forming a transfer fixing nip by disposing a heat source 102 inside a driving roller 101 of an intermediate transfer member 100 and by pressure welding a pressurizing member 103 to the intermediate transfer member 100 as shown in FIG. 1 is proposed. It is a kind of method in which toner is heated before going through the transfer fixing nip and the heated toner is then transferred and fixed to a recording medium 104 from the intermediate transfer member 100 through the transfer fixing nip. The symbol 105 represents four image bearing members of each color and 106 represents primary transfer units for each image bearing member 105. By this method, secondary transferring from the intermediate transfer member 100 to the recording medium 104 is performed by the heat for fixing instead of electrostatic force. Moreover, it is possible to set heating time of toner longer.

In the method stated in JP-B No. 3042414, the intermediate transfer member 100 is also heated for the same time interval as the heating time of toner and in addition, the intermediate transfer member 100 is heated from inside to the whole member in a layer thickness direction. Because of this, when the intermediate transfer member 100 enters a primary transfer area, the image bearing members 105 are also heated by the heat of the intermediate transfer member 100, resulting in problems such as toner fixation.

The image forming apparatus stated in JP-A No. 2004-145260 is equipped with a transfer fixing member in which an image formed in a traveling direction of an intermediate transfer member for preventing heating of the intermediate transfer member is transferred, a heating unit which heats the image on the transfer fixing member and a pressurizing unit which forms a transfer fixing nip with the above transfer fixing member and the image is transferred and fixed from the transfer fixing member to a recording medium tertiarily after the image is transferred and fixed from the intermediate transfer member to the transfer fixing member.

Meanwhile, it is common to use electrically chargeable fine particles consisting mainly of resin which is called toner as a member for making up an image in these techniques.

For the conventional image forming apparatus, image quality tends to be degraded in a step of transferring to a recording medium. Paper, the mainly used recording medium varies from regular paper to heavy paper and its surface property also varies from high quality to irregular paper. Specifically in the case of paper with a rough surface property, microscopic gaps are formed due to an intermediate transfer member which cannot follow the surface property of the paper, an abnormal discharge occurs in the microscopic gaps, an image is not transferred normally and tends to be indistinct.

In contrast, because transfer and fixing are performed simultaneously in the image forming apparatus which contains a transfer fixing step such as above, the degradation of image quality is least likely to occur even when paper with a rough surface property is used. This is because heat is added simultaneously during transfer, toner is softened and melted by heat to become a viscoelastic block-shaped mass, making it easier for the image even in the microscopic gap of paper to be transferred. Because of the advantage such as above, the image forming apparatus having a transfer fixing unit can be said to be suitable for forming images of high quality.

However, a transfer fixing ratio is low and graininess is inappropriate for the highlight area produced by these fixing methods. In other words, it is known that the toner is unlikely to be shifted to a recording medium sufficiently and images are not improved and sometimes may be degraded compared to normally-operated electrostatic-transfer methods. Furthermore, it has been found that when energy added during transfer fixing is increased in order to improve the transfer fixing ratio and image quality of a highlight area, the transfer fixing ratio of the highlight area becomes appropriate even in the highlight area, however, problems of irregularity in fixing and glossiness may occur in high-density areas where a toner amount is high due to excessive fixation of the toner.

Toner viscosity from molten condition to transfer fixing is regulated in JP-B Nos. 3042414 and 3021352 for improvement. However, when a nip time, the time it takes for a recording medium to pass through a fixing nip is set at 30 ms or less for achieving high-speed printing, if there is a tiny difference in viscosity in the toner image, fixation to the recording medium is inhibited and a sufficient transfer property in order to produce a sufficient anchoring effect of a toner image on a recording medium cannot be obtained and as a result, degradation of highlight was unavoidable.

SUMMARY OF THE INVENTION

The first object of the present invention is to obtain high-quality, high-stability images wherein hot offset hardly occurs by making high-speed fixing possible to be applicable for high-speed printing.

The second object of the present invention is to prevent temperature rise of the intermediate transfer member, making low-temperature fixing at high speed possible.

The third object of the present invention is to effectively apply the heat provided by a heating unit to transfer fixing in order to shorten the warm-up time and achieve energy conservation.

The fourth object of the present invention is to obtain high-quality, high-stability images even in a highlight area and a high-density area.

The fifth object of the present invention is to provide an excellent low-temperature fixing property and appropriate transparency and glossiness.

The sixth object of the present invention is to improve heat resistance of a toner image on a recording medium.

The seventh object of the present invention is to increase compatibility of a toner relative to a recording medium to improve transfer property.

The eighth object of the present invention is to increase releasing property of a transfer fixing member, making oil coating of the transfer fixing member unnecessary.

The ninth object of the present invention is to make stable fixing possible.

The tenth object of the present invention is to make low-temperature fixing possible while maintaining heat resistance.

The eleventh object of the present invention is to further make low-temperature fixing possible.

The twelfth object of the present invention is to be able to exhibit effect of low-temperature fixing at a maximum.

The image forming apparatus of the present invention is equipped with an image bearing member, a latent electrostatic image forming unit which forms a latent electrostatic image on the image bearing member, a developing unit which develops the latent electrostatic image by using a toner to form a toner image, a transfer fixing member which bears the toner image, a heating unit which heats the toner image on the transfer fixing member, and a pressurizing member which forms a transfer fixing nip with the transfer fixing member, wherein the toner image on the transfer fixing member is transferred and fixed simultaneously to a recording medium which passes through the transfer fixing nip to record an image on the recording medium, the nip time, the time it takes for the recording medium to pass through the transfer fixing nip is 30 ms or less, the toner contains at least a binder and the binder has a main peak in an area of 5,000 to 15,000 molecular weight in a molecular weight distribution measured by GPC, and the component of 30,000 or more molecular weight is 0.05% or less and a value of weight-average molecular weight (Mw)/number average molecular weight (Mn), Mw/Mn is 2 to 6 in order to make high speed fixing possible and to be applicable for high speed printing and to obtain high-quality, high-stability images wherein hot offset hardly occurs. Meanwhile, nip time is a value obtained by dividing a nip width of the transfer fixing nip by feed speed of the recording medium.

An image forming method of the present invention includes forming a latent electrostatic image on the image bearing member, developing the latent electrostatic image by using a toner to form a toner image and transfer fixing using a transfer fixing member which bears the toner image, a heating unit which heats the toner image on the transfer fixing member and a pressurizing member which forms a transfer fixing nip with the transfer fixing member, wherein the toner image on the transfer fixing member is transferred and fixed simultaneously to a recording medium which passes through the transfer fixing nip to record an image on the recording medium, the nip time, the time it takes for the recording medium to pass through the transfer fixing nip is 30 ms or less, and the toner contains at least a binder and the binder has a main peak in an area of 5,000 to 15,000 molecular weight in a molecular weight distribution measured by GPC, and the component of 30,000 or more molecular weight is 0.05% or less and a value of weight-average molecular weight (Mw)/number average molecular weight (Mn), Mw/Mn is 2 to 6.

DESCRIPTION OF THE PREFERRED EMBODIMENTS

First, before explaining specific composition, the background about how inventors arrived at the thought of the image forming apparatus of the present invention will be explained. In the fixing device of the image forming apparatus of the present invention, a pressurizing member is applied to a fixing member with a built-in heat source, recording paper is held and transported at the applied position and it becomes a transfer fixing nip which is a heating position. Rollers or belts are used as fixing members and rollers, belts or fixed pads are used as pressurizing members.

On one hand, images which are transferred include not only images of single color, but also of multiple colors such as full-color. With regard to fixing of such images, fixing property, particularly temperature property in accordance with embodiments of images being transferred becomes important. The temperature property affects heat transfer between toner and recording paper. The heat transfer changes depending on a surface temperature of the toner which is in contact with fixing members and surface temperatures (interface temperatures) of the toner and recording paper which is in contact with the toner. Of temperature property, the surface temperature of the toner affects glossiness required for full-color image, etc. The surface temperature of the toner and recording paper which is in contact with the toner affects penetrance (adhesiveness) of the toner relative to the recording paper.

Figure 1:
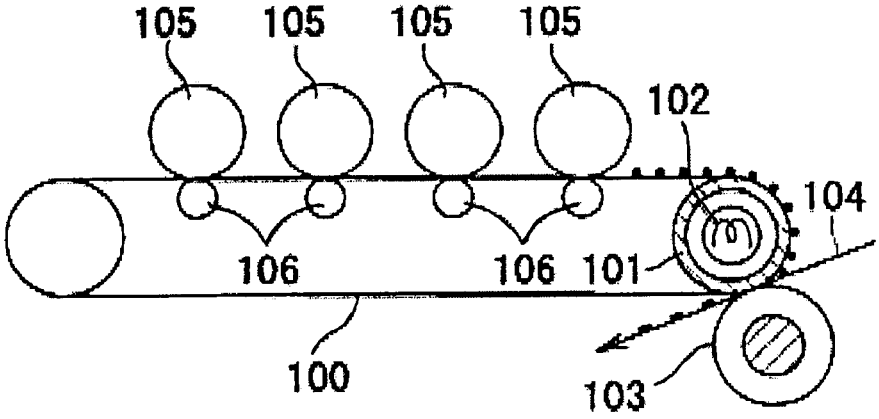
FIG. 1 PRIOR ART
FIG. 1 is a schematic block diagram of a substantial part of a conventional image forming apparatus.
Figure 2:
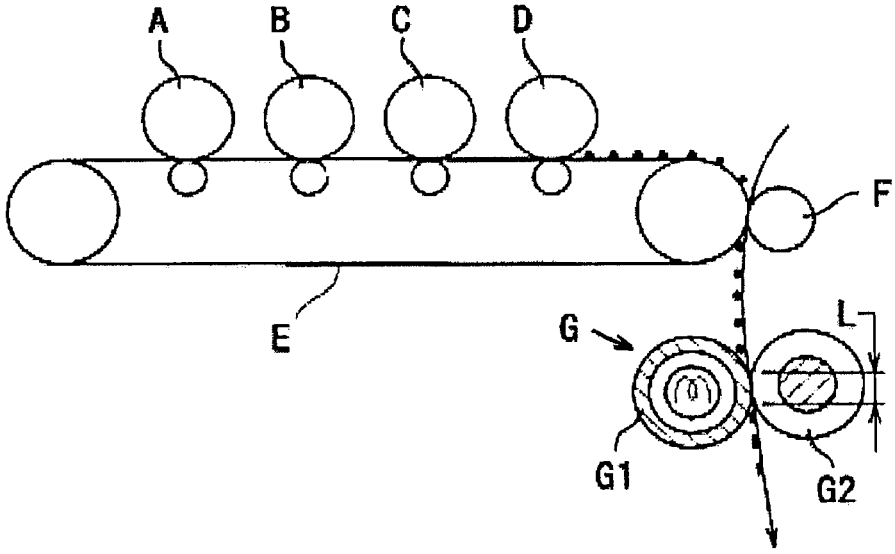
FIG. 2 PRIOR ART
FIG. 2 is a schematic block diagram of a substantial part of another conventional image forming apparatus.

A fixing device of full-color image forming apparatus is shown in FIG. 2. In the fixing device, image bearing members A to D capable of forming images of each color are arranged, and an intermediate transfer member E, which corresponds to a primary transfer member and is extended in a direction of the arrangement, is disposed in order for the images of each color to be transferred sequentially to the intermediate transfer member E. A transfer device F is disposed so as to be facing and in contact with the intermediate transfer member E as a secondary transfer member for transferring images transferred on top of each other to a recording paper at once. And then the recording paper on which images are transferred at once is conveyed toward a fixing device G.

The fixing device G as shown in FIG. 2 has a composition which employs a heat roller fixing method equipped with a fixing roller G1 and a pressurizing roller G2 which are facing and in contact with each other and form a transfer fixing nip of distance L and an unfixed image on the recording paper is fixed by heat generated from the fixing roller G1. The heat roller fixing method is advantageous in being able to achieve higher speed because of high heat efficiency, in being able to obtain stable fixing efficiency because of high heat transfer efficiency and in having simple structure because it is usable as a conveying medium of the recording paper and is being frequently used recently.

A warming-up operation is performed for the fixing device G until it reaches a predetermined temperature. In the case of a full-color image, approximately 1.5 times or more of heat quantity is required because of overlapped toner thickness which is thicker than that of a single-colored image such as a black and white image. Because of this, the heat quantity added to the recording paper has a tendency of increasing compared to the case when a single-colored image is obtained, and not only the recording paper is likely to be in a heated condition, but also when many full-color images are being fixed at high speed, electrical power for heating may become deficient with power capacity of power sources for business such as 100V and 15A.

When excessive heating occurs, the recording paper itself becomes excess. Such phenomenon does not conform to the users' want when handling recording paper, and when the toner is softened again by excessive heat, stacked recording paper is attached firmly to each other, resulting in degradation of workability such that the recording paper have to be peeled off when being taken out. As for the failures due to excessive heating, when recording paper such as the one of which surface is coated specially for preventing blurring is used for image forming by mistake instead of recording paper such as regular paper on which toner is transferred, coating material is transferred to a fixing member by heat, that is, offset is likely to occur, and smear or winding of recording paper tends to occur at the fixing member. By this, unnecessary work not required essentially for an image forming apparatus such as clearing of winded recording paper or cleaning up of fixing members becomes necessary and it is disadvantageous in terms of workability.

In the apparatus, which uses the electrophotographic method for image forming, images are transferred to a recording paper electrostatically by applying electric bias from the backside of the recording paper. In this case, because electric properties of recording paper tend to change depending on the conditions such as hygroscopic property, thickness, surface property (irregularity), and the like of the recording paper, maintaining constant transfer properties when images on the image bearing member are transferred to the recording paper directly or through an intermediate transfer member is difficult, and it is likely to result in abnormal images.

On one hand, images transferred to the recording paper are heated in a fixing device, and the temperatures differ in a toner thickness direction during fixing. In other words, in the case of the composition as shown in FIG. 2, heating first begins at a point where the images reach the fixing device G, and the toner temperature on the surface layer side which corresponds to the opposite side of the interface side of the recording layer becomes considerably low in a thickness direction compared to the toner temperature on the interface side of the recording paper, resulting in an increase in temperature gradient in a layer thickness direction.

The fixing temperature may be increased in order to solve the above problem, however, when heating temperature is increased, heating burden (increase in power consumption) increases, and heating condition of a recording paper or problems caused by resoftening of a toner are not solved because the heating condition such as described above is easily obtained.

The present invention has been substantiated based on the prospect as mentioned above.

The image forming apparatus of the present invention contains an image bearing member a latent electrostatic image forming unit which forms a latent electrostatic image on the image bearing member, a developing unit which develops the latent electrostatic image using a toner to form a toner image, a transfer fixing member which bears the toner image, a heating unit which heats the toner image on the transfer fixing member and a pressurizing unit which forms a transfer fixing nip with the transfer fixing member, and other units such as a cleaning unit, an electricity removal unit and a control unit as necessary.

The image forming method of the present invention includes latent electrostatic image forming, developing, transfer fixing using a transfer fixing member which bears a toner image, a heating unit which heats the toner image on the transfer fixing member and a pressurizing unit which forms a transfer fixing nip with the transfer fixing member, and other steps as necessary.

Materials, shapes, structures or sizes of the image bearing member (hereinafter, may be referred to as "electrophotographic photoconductor" or "photoconductor") are not particularly limited and may be selected from known image bearing members accordingly and drum-shaped ones are preferable. The materials thereof are, for example, inorganic photoconductors such as amorphous silicon and selenium; organic photoconductors such as polysilane, phthalopolymethine, and the like. Of these examples, amorphous silicon is preferred for its long operating life.

Latent Electrostatic Image Forming Unit and Latent Electrostatic Image Forming

The latent electrostatic image may be formed, for example, by uniformly charging the surface of the image bearing member and irradiating it imagewise, and this may be performed by the latent electrostatic image forming unit. The latent electrostatic image forming unit, for example, contains a charger which uniformly charges the surface of the image bearing member and an exposure machine which exposes the surface of the image bearing member imagewise.

Charging may be performed, for example, by applying a voltage to the surface of the image bearing member using a charger.

The charger is not particularly limited and may be selected accordingly. Examples of the charger include known contact chargers equipped with a conductive or semi-conductive roller, a brush, a film or a rubber blade and non-contact chargers using corona discharges such as a corotron or a scorotron, etc.

Exposures may be performed by exposing the surface of the image bearing member imagewise by using the exposure machine, for example.

The exposure machine is not particularly limited as long as it is capable of exposing the surface of the image bearing member that has been charged by the charger to form an image as intended, and may be selected accordingly. Examples thereof include various exposure machines such as a copy optical system, a rod lens array system, a laser optical system and a liquid crystal shutter optical system.

A backlight system may be employed in the present invention by which the image bearing member is exposed imagewise from the rear surface.

Developing and Developing Unit

Developing is a step by which a latent electrostatic image is developed using a toner and/or developer to form a visible image and it is performed by using a developing unit.

The visible image may be formed, for example, by developing the latent electrostatic image using a toner and/or developer.

The developing unit is not particularly limited as long as it is capable of developing by using a toner and/or developer, for example, and may be selected from known developing units accordingly. Suitable examples thereof include a developing unit having at least a developing machine which contains the toner and/or developer and can supply toner and/or developer to the latent electrostatic image by contact or with no contact and it is preferably the developing machine equipped with a container which contains the toner.

The developing machine may be of a dry developing system or a wet developing system and may also be for single or multiple colors. Preferred examples include a developing machine having a mixer whereby toner and/or developer is charged by friction-stirring and rotatable magnet rollers.

In the developing machine, the toner and the carrier may, for example, be mixed and stirred together. The toner is thereby charged by friction, and forms a magnetic brush on the surface of the rotating magnet roller. Since the magnet roller is arranged near the image bearing member (photoconductor), part of the toner constructing the magnetic brush formed on the surface of the magnet roller is moved toward the surface of the image bearing member (photoconductor) due to electrical attraction force. As a result, a latent electrostatic image is developed by the toner, and a visible toner image is formed on the surface of the image bearing member (photoconductor).

The best embodiment of the present invention will be explained specifically referring to figures below.

First, a general outline of the composition and operation of an exemplary tandem color copier of the present invention will be explained based on FIG. 3. A color copier 1 contains an image forming unit 1A located in the center of the copier 1, a paper feed unit 1B located below the image forming unit 1A and an image reading unit (not shown) located above the image forming unit 1A.

An intermediate transfer belt 2 is arranged in the image forming unit 1A as an intermediate transfer member having a transfer surface extended in a horizontal direction and a composition for forming images of colors having complementary relations with colors for color separation is disposed on the upper surface of the intermediate transfer belt 2. In other words, photoconductors 3B, 3C, 3M and 3Y as image bearing members which can bear images by toner of colors with complementary relations (black, cyan, magenta and yellow) are arranged along the transfer surface of the intermediate transfer belt 2. The order of each color is not limited to above.

Each photoconductor, 3B, 3C, 3M and 3Y is composed by a drum which can be rotated in the same direction (in counterclockwise direction), and charging devices 4B, 4C, 4M and 4Y which perform an image forming process during rotating, writing devices 5B, 5C, 5M and 5Y as optical writing units, developing devices 6B, 6C, 6M and 6Y, primary transfer devices 7B, 7C, 7M and 7Y and cleaning devices 8B, 8C, 8M and 8Y are arranged around the photoconductors 3B, 3C, 3M and 3Y. The alphabets provided to each symbol correspond to the toner color as for the photoconductor 3B, 3C, 3M and 3Y. Each developing device 6B, 6C, 6M and 6Y contains a toner of each color.

The intermediate transfer belt 2 has a composition which can be moved to the same direction as driven by a driving roller 9 and a driven roller 10 while in a position facing the photoconductors 3Y, 3M, 3C and 3B. A cleaning device 11, which cleans a surface of the intermediate transfer belt 2 is disposed facing the driven roller 10.

A surface of the photoconductor 3B is charged uniformly by the charging device 4B and writing is performed based on the image information provided from the image reading unit by the writing device 5B to form a latent electrostatic image on the photoconductor 3B. The latent electrostatic image is then made visible as a toner image by attaching a toner provided from the developing device 6B which contains black toner. The toner image is primarily transferred on the intermediate transfer belt 2 by the primary transfer device 7B to which a predetermined bias is applied. The developing device 6B stated here is not limited only to either one of a one component developing device and a two-component developing device. Images are formed similarly with the other photoconductors 3C, 3M and 3Y differing only in color of toner and toner images of each color are transferred to the intermediate transfer belt 2 in sequence to be overlapped with each other.

The residual toner on the photoconductor 3B is removed by the cleaning device 8B after image transfer. Furthermore, electric potential of the photoconductor 3B is initialized by a charge removing lamp (not shown) after image transferring to be ready for the next image forming process.

A fixing device 12 is disposed near the driving roller 9. The fixing device 12 contains a roll-shaped transfer fixing member 13 by which an unfixed toner image as an image on the intermediate transfer belt 2 is transferred and a roll-shaped pressurizing member 14 which forms a transfer fixing nip N with the transfer fixing member 13. The transfer fixing member 13 which bears a toner image is pipe shaped and made of a metal such as aluminum and a releasing layer is applied to the surface of the transfer fixing member 13. In addition, a heating unit 15 which heats the toner image on the transfer fixing member 13 is disposed inside the transfer fixing member 13. For example, a halogen heater is used as the heating unit 15. On the other hand, the pressurizing member 14 has a cored bar 14*a* and an elastic layer 14*b* such as rubber.

The paper feed unit 1B contains a paper feed tray 16 which contains recording paper P as a recording medium, a paper feed roller 17 which feeds paper by separating the recording paper P in the paper feed tray 16 one by one from the uppermost paper, a conveying roller 18 which conveys the recording paper P and a resist roller 19 by which the recording paper P is sent to the transfer fixing nip N by the timing in which a leading end of the image on the transfer fixing member 13 and a predetermined position in a conveying direction agree with each other after the recording paper P is stopped temporarily to correct a diagonal misalignment.

A toner image T primarily transferred to the image transfer belt 2 from the photoconductors 3B, 3C, 3M and 3Y is secondarily transferred to the transfer fixing member 13 electrostatically by a bias (including superposition such as AC, pulse, etc.) applied to the driven roller 10 by a bias applying unit (not shown).

Figure 3:
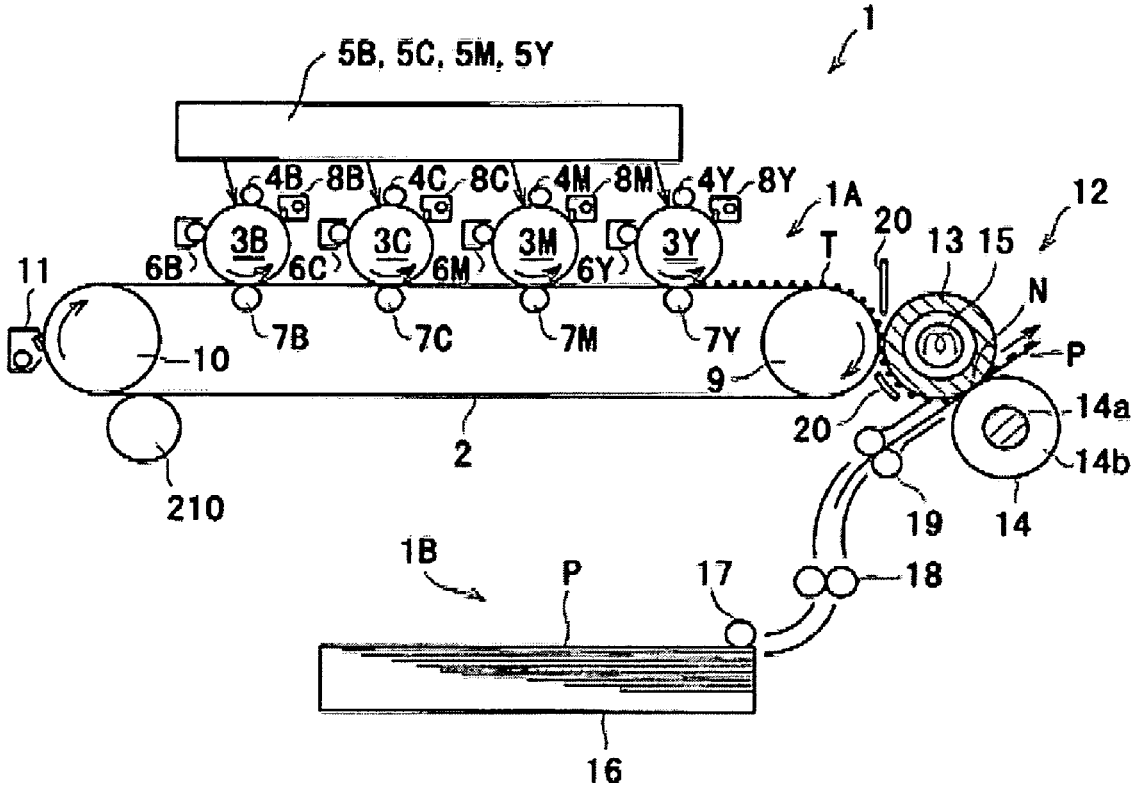
FIG. 3 is a schematic block diagram of a substantial part of an exemplary tandem-type color copier of the present invention.

As shown in FIG. 3, a heat-insulating plate 20 as a heat shielding member or heat migration suppressing member which suppresses heat radiation (heat migration) from the transfer fixing member 13 to the intermediate transfer belt 2 is disposed between the intermediate transfer belt 2 and the transfer fixing member 13. The heat-insulating plate 20 is formed in a way so as to have an opening in order to suppress the heat radiation to the intermediate transfer belt 2 while not inhibiting the secondary transfer from the intermediate transfer belt 2 to the transfer fixing member 13, and it can be disposed on either side of the fixing device 12 and the image forming device (not shown). A plate-like member which has a metallic gloss with low emittance is preferable as the heat migration suppressing member and excellent effect is obtainable by arranging two metal sheets so as to sandwich a microscopic airspace or heat-insulating material. Furthermore, the heat migration suppressing member can be maintained at low temperatures and heat migration can be suppressed when a thin plate which contains a micro-heat pipe structure used for cooling down a CPU of laptop personal computers is used.

In addition, a cooling roller 210, which removes heat from the intermediate transfer belt 2, is disposed between the transfer unit (the unit facing the transfer fixing member 13) of the intermediate transfer member 2 facing the transfer fixing belt 13 and the transfer unit facing the photoconductor 3B on the uppermost side. The cooling roller 210 is formed of a material with high heat conductivity, and it rotates by contact with the intermediate transfer belt 2. In this example, it is of a composition in which heat-insulating plate 20 and the cooling roller 210 are disposed simultaneously, however, it may be of a composition having either one of the heat-insulating plate 20 and the cooling roller 210. In this example, a temperature of the intermediate transfer belt 2, which is an intermediate transfer member, can be lowered, and degradation of the intermediate transfer belt 2 by heat can be suppressed. Moreover, degree of freedom in designing the transfer fixing member 13 may be increased.

The toner image T transferred to the transfer fixing member 13 from the intermediate transfer belt 2 is heated independently on the transfer fixing member 13 until it is fixed to the recording paper P by the transfer fixing nip N. Because a heating process in which only the toner image T is heated in advance can be obtained satisfactorily, the heating temperature can be lowered as compared to that of the conventional method in which the toner image T and the recording paper P are heated simultaneously. As a result of experiment, it was confirmed that sufficient image quality can be obtained even with a low temperature of the transfer fixing member 13, a melting temperature of the toner image Tmt+10° C.

The melting temperature of the toner image is preferably less than Tmt+50° C. for energy conservation because the fixing temperature is suppressed low.

The untransferred toner left on the transfer fixing member 13 at the transfer fixing nip N or unfixed toner left on the transfer fixing member 13 during paper jamming are removed by a cleaning roller 22. The toner image on the transfer fixing member 13 at this time is in a condition of being heated and melted. A plural numbers of concave portions are formed on the surface of the cleaning roller, and the concave portions have a width more than that of the transfer fixing member 13.

Materials with lower releasing property are selected as compared to that of the transfer fixing member 13 for the material used for the surface layer of the cleaning roller.

The surface layer of the transfer fixing member 13 is mainly selected from perfluoro resins of chemical structure in which most of hydrogen is substituted with fluorine such as PTFE, PFA, FEP, and the like which excel in releasing property. Several % or less of filling materials such as carbon may be contained in these perfluoro resins in order to obtain electric conductivity or wear resistance. The releasing property may be expressed by contact angle of water. The contact angle is related to surface energy and as the surface energy decreases, contact angle increases. It is known that these materials have the smallest surface energy and contact angle ranges from 110° to 115°.

In contrast, using materials with contact angle of 70° to 95° for the surface layer of the cleaning roller is effective for transferring the molten toner to the pressurizing member side. It is easy to obtain materials of the above contact angle by fluorine resins having a structure in which half of hydrogen is substituted with fluorine such as PTFE, PFA and FEP to which 10% by mass to 20% by mass of filling materials such as carbon, glass fiber or ceramic which excel in wear resistance, molybdenum disulfide which excels in sliding property are added, ETFE which excels in mechanical strength, and the like. Moreover, wear resistance is ensured as well as wear damage caused by scraping out of the toner is suppressed by containing a large amount of filling materials and it is extremely suitable. Toner is fixed easily with the contact angle of less than 70°, and scraping out becomes difficult.

A cooling member (not shown) may be disposed on the transfer fixing member 13 after the cleaning roller for preventing heat migration to the intermediate transfer belt 2 as necessary.

The toner image T on the transfer fixing member 13 transferred from the intermediate transfer belt 2 to the transfer fixing member 13 is tertiarily transferred and fixed simultaneously to the recording paper P passing through the transfer fixing nip N and the image is recorded on the recording paper P. The toner image is heated on the transfer fixing member 13 independently before it is transferred and fixed. Because a process in which the only toner image T is heated in advance can be obtained satisfactorily, heating temperature can be lowered as compared to that of the conventional method in which the toner image T and the recording paper P are heated simultaneously. As a result of experiment, it was confirmed that sufficient image quality can be obtained even with a low temperature of the transfer fixing member 13, a melting temperature of toner image Tmt+10° C.

As described above, 1.5 times of energy has been provided in the conventional color image forming apparatus as compared to black and white image forming apparatus in consideration of decrease in temperature by recording paper for obtaining sufficient glossiness. For this, recording paper is heated more than it is needed, and adhesion property of toner and recording paper are also increased beyond necessity. In this example, however, the temperature for obtaining sufficient glossiness can be adjusted independently without consideration of recording paper P, it is possible to lower the temperature (fixing temperature) of the transfer fixing member 13. In addition, because recording paper P is heated only by the transfer fixing nip N, excessive heating can be avoided and adhesion property of the toner image T and the recording paper is not increased needlessly.

Figure 4:
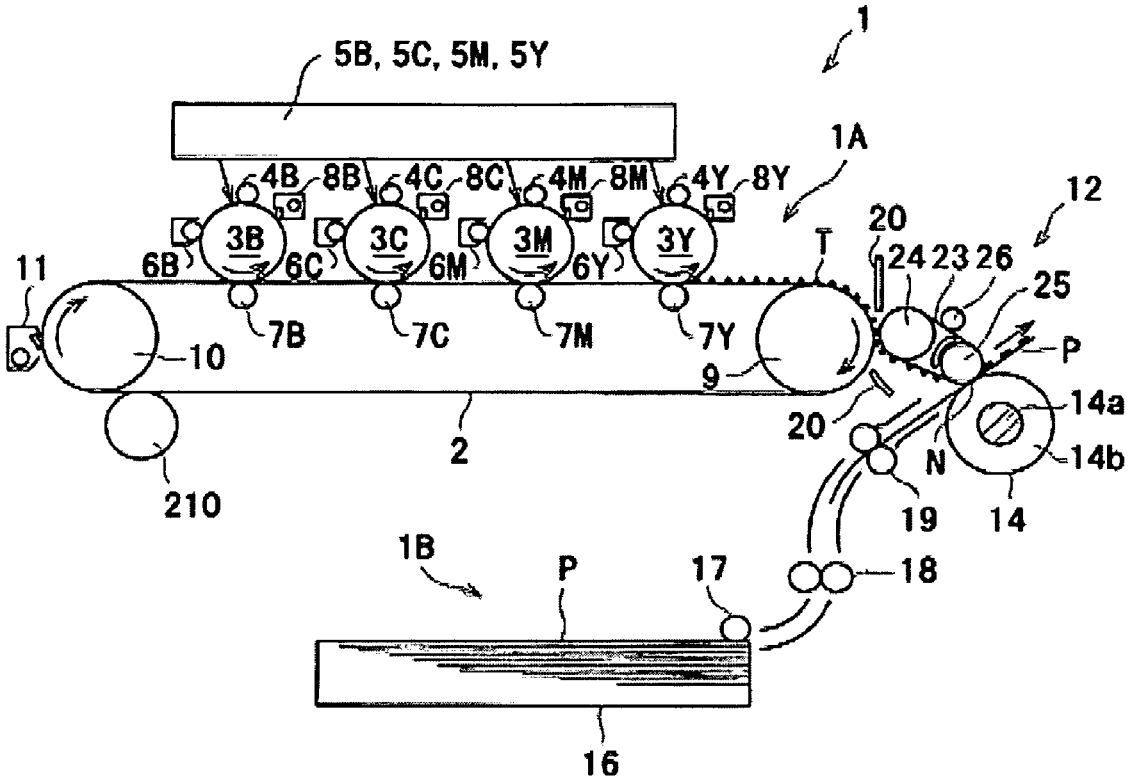
FIG. 4 is a schematic block diagram of a substantial part of another exemplary tandem-type color copier of the present invention.

A composition of another example of a tandem color copier of the present invention is shown in FIG. 4.

In the example as shown in FIG. 4, a belt-shaped transfer fixing member 23 is used instead of the roll-shaped transfer fixing member 13 as shown in FIG. 3, a tension roller 26 is pressed from outside by a rotation of two rollers 24 and 25 and a IH heater which heats the roller 25 on the tertiary transfer side which presses a pressurizing member 14 is disposed. Other equipments are as similar to the composition as shown in FIG. 3 and description will be omitted by using the same symbols as used in FIG. 3.

In this example, the transfer fixing member 23 is belt-shaped, toner images formed on the photoconductors 3B, 3C, 3M and 3Y as image bearing members are primarily transferred to the intermediate transfer belt 2 as an intermediate transfer member, the toner image on the intermediate transfer belt 2 is secondarily transferred to the belt-shaped transfer fixing member 23 and the toner image on the transfer fixing member 23 is tertiarily transferred to the recording paper P.

Figure 5:
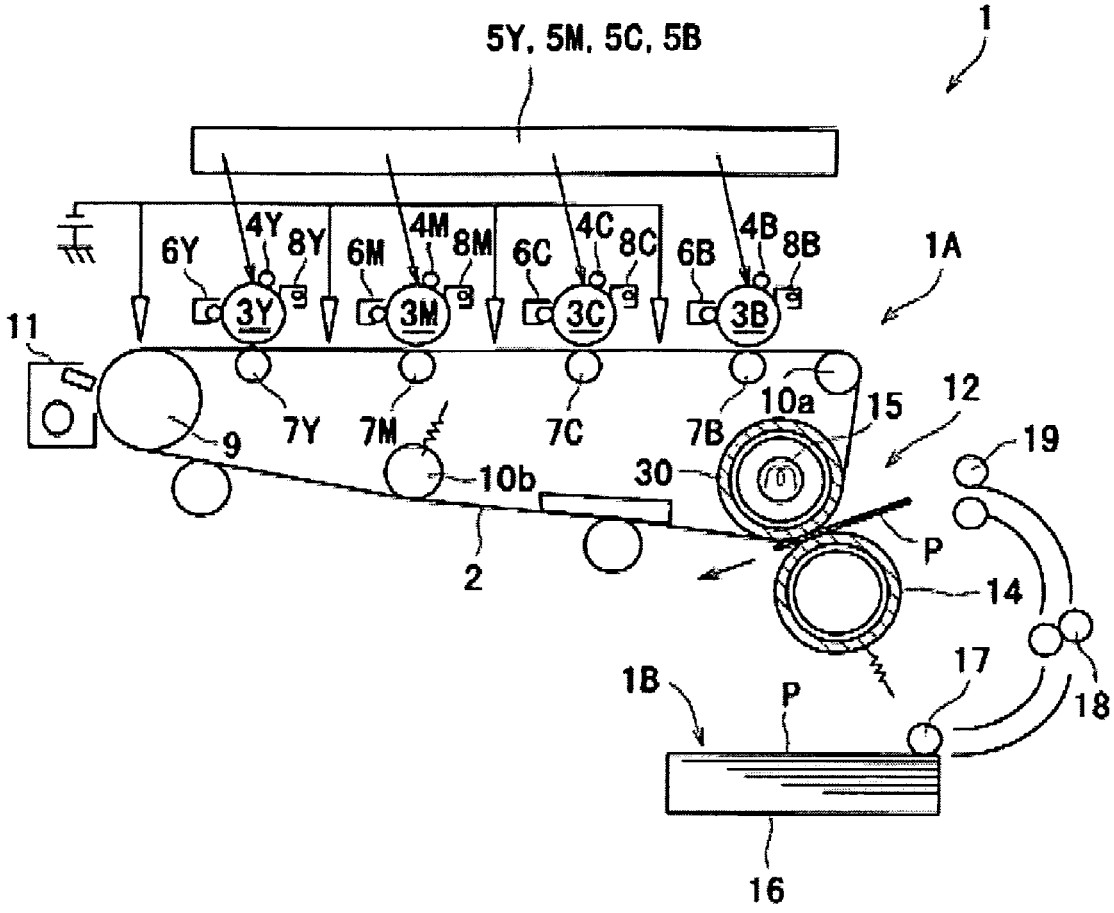
FIG. 5 is a schematic block diagram of a substantial part of another exemplary tandem-type color copier of the present invention.

A composition of another example of a tandem color copier of the present invention is shown in FIG. 5.

A color copier 1 contains an image forming unit 1A which is located at the center of the copier 1, a paper feed unit 1B which is located below the image forming unit 1A and an image reading unit (not shown) which is located above the image forming unit 1A.

An intermediate transfer belt 2 is arranged in the image forming unit 1A as an intermediate transfer member having a transfer surface extended in a horizontal direction and photoconductors 3B, 3C, 3M and 3Y as image bearing members which can bear images by toners (black, cyan, magenta and yellow) are arranged along the transfer surface of the intermediate transfer belt 2, which is an upper side of the intermediate transfer belt 2. The order of each color is not limited to the above.

Each photoconductor, 3Y, 3M, 3C and 3B is composed by a drum which can be rotated in the same direction (in counterclockwise direction), and charging devices 4Y, 4M 4C and 4B which perform an image forming process during rotating, writing devices 5Y, 5M, 5C and 5B as optical writing units, developing devices 6Y, 6M, 6C and 6B, primary transfer devices 7Y, 7M, 7C and 7B and cleaning devices 8Y, 8M, 8C and 8B are arranged around the photoconductors 3Y, 3M, 3C and 3B. The alphabets provided to each symbol correspond to the toner color as for the photoconductors 3Y, 3M, 3C and 3B. Each developing device 6Y, 6M, 6C and 6B contains a toner of each color.

The intermediate transfer belt 2 has a composition which can be moved to the same direction driven by a driving roller 9 and driven rollers 10*a* and 10*b* in a position facing the photoconductors 3Y, 3M, 3C and 3B. A cleaning device 11, which cleans a surface of the intermediate transfer belt 2 is disposed facing the driving roller 9.

A surface of the photoconductor 3Y is charged uniformly by the charging device 4Y and a latent electrostatic image is formed on the photoconductor 3Y according to the image information provided from the image reading unit. The latent electrostatic image is then made visible as a toner image by the developing device 6Y which contains yellow toner. The toner image is then primarily transferred on the intermediate transfer belt 2 by the primary transfer device 7Y which is a transfer fixing member, to which a predetermined bias is applied. Images are formed similarly with the other photoconductors 3M, 3C and 3B differing only in color of toner and toner images of each color are transferred to the intermediate transfer belt 2 in sequence to be overlapped with each other.

The residual toner on the photoconductor 3Y is removed by the cleaning device 8Y after transferring. Furthermore, electric potential of the photoconductor 3Y is initialized by a charge removing lamp (not shown) after transferring to be ready for the next image forming process.

A fixing device 12 is disposed near the driven roller 10*a*. The fixing device 12 contains a heating roller 30 as a heating unit by which an unfixed toner image as an image on the intermediate transfer belt 2 is heated and a roll-shaped pressurizing member 14 which forms a transfer fixing nip with the heating roller 30. The heating roller 30 is made of a metal such as aluminum and is pipe-shaped. In addition, a halogen heater 15 as a heating unit which heats the image on the intermediate transfer belt 2 is disposed inside the heating roller 30.

The paper feed unit 1B contains a paper feed tray 16 which contains recording paper P as a recording medium, a paper feed roller 17 which feeds paper by separating the recording paper P in the paper feed tray 16 one by one in sequence from the uppermost paper, a conveying roller 18 which conveys the recording paper P provided from the paper feed roller and a resist roller 19 by which the recording paper P is sent to the transfer fixing nip by the timing in which a leading end of the image on the transfer fixing member and a predetermined position in a conveying direction agree with each other after the recording paper P is stopped temporarily to correct a diagonal misalignment.

The toner image primarily transferred to the image transfer belt 2, which is a transfer fixing member, from the photoconductors 3Y, 3M, 3C and 3B is secondarily transferred and fixed simultaneously to the recording paper P passing through the transfer fixing nip and the image is recorded on the recording paper P. The toner image is heated on the intermediate transfer belt 2 independently before it is transferred and fixed. Because it is possible to heat only the toner image in advance satisfactorily, heating temperature can be lowered as compared to that of the conventional method in which the toner image and the recording paper P are heated simultaneously. As a result of experiment, it was confirmed that sufficient image quality can be obtained even with a low temperature of the heating roller 30, a melting temperature of toner image Tmt+10° C.

As described above, 1.5 times of energy has been provided in the conventional color image forming apparatus as compared to a black and white image forming apparatus in consideration of decrease in temperature by recording paper for obtaining sufficient glossiness. For this, recording paper is heated more than it is needed, and adhesion property of toner and recording paper are also increased beyond necessity. In this example, however, the temperature for obtaining sufficient glossiness can be adjusted independently without consideration of recording paper P, it is possible to lower the temperature (fixing temperature) of the transfer fixing member. In addition, because recording paper P is heated only by the transfer fixing nip, excessive heating can be avoided and adhesion property of the toner image and the recording paper is not increased needlessly.

In this example, it is possible to shorten the warm-up time, thereby enhancing the energy conservation effect because fixing at low temperatures is possible. Moreover, because heat migration to the intermediate transfer belt 2 as an intermediate transfer member can be suppressed, durability can be improved. And the temperature of the intermediate transfer belt 2 can be lowered and degradation of intermediate transfer belt 2 by heat can be suppressed. The surface temperature T1 of the transfer fixing member 13 for this is Tmt+50° C. or less.

As described above, the fixing device 12 in this example itself has a function to bear a transferred unfixed toner image, and it may be defined as a "transfer fixing device", as it differs from a conventional fixing device by which a recording paper having an unfixed toner image is simply heated and pressurized.

Common methods for pursuing a fixing property at low temperatures and hot offset resistance simultaneously when the above-mentioned conventional fixing device as shown in FIG. 2 is used include a method in which binder resins of wide molecular weight distribution are used and a method in which resins having at least two molecular weight peaks of high molecular component with hundreds of thousand of or multimillion molecular weight and low molecular component with several thousands or millions of molecular weight are mixed for use and functions of each component are separated, for example. It is more effective for preventing hot offset if the high molecular component contains a cross-linked structure or is in gel form. On one hand, molecular weight is preferably small as much as possible and molecular weight distribution is preferably sharp in order to achieve transparency and glossiness, and therefore, it is thought to be difficult to pursue these contradictory properties simultaneously with the above methods only.

However, temperature history of the toner image on the transfer fixing member, recording medium and fixing member of the fixing device in the image forming apparatus of the present invention significantly differ from those of the conventional fixing device. In the fixing device of the image forming apparatus of the present invention, the toner image on the transfer fixing member is sufficiently heated to a temperature approximately equal to the surface temperature of the transfer fixing member uniformly and in addition, heat loss from the transfer fixing member to the recording medium is extremely small, and the heated toner image is cooled is rapidly by contact with the recording medium. Therefore, it became apparent that the properties required for the toner in the fixing device of the image forming apparatus of the present invention clearly differs from that of the toner in the conventional fixing device.

The transfer fixing ratio of the fixing device used for the image forming apparatus of the present invention is low and graininess is inappropriate in a highlight area. In other words, toner is not transferred to a recording medium satisfactorily and degradation of image is not improved as compared to the electrostatic transfer method commonly performed and it is more degraded in some cases.

The cause of the problem in a method in which transfer and fixing are performed simultaneously relating to reproducibility in the above-mentioned highlight area was searched. It turns out that the toners are distributed unevenly in a highlight area, energy during transfer and fixing is not transmitted to uneven toners appropriately due to surface irregularity of the recording paper, which is a recording medium, and moreover, toner is not transferred to the recording medium properly because aggregation of toners are not likely to be sufficient. It was confirmed that it is important for each toner, which is a particle, to be concentrated to form an image also in a highlight area in order to obtain a high-quality highlight image using the method in which transfer and fixing are performed simultaneously. This is because energy is easily transmitted during transfer and fixing and fusion and cohesive force between toners work without being affected by surface irregularity of the paper when toners are concentrated.

In conventional image forming apparatuses disclosed in JP-B Nos. 3042414 and 3021352, toner viscosity from molten condition to transfer/fixing is defined considering the disturbance of images by flow due to capillary phenomenon of the molten toner. However, in the image forming apparatus of the present invention in which nip time is set at 30 ms or less, flow due to capillary phenomenon does not occur because the heated toner image is separated from the recording medium during cooling by contact with the recording medium, and it has been found by the present inventors that the toner image on the transfer fixing member is needed to be melted satisfactorily and the viscosity of the molten toner in the microscopic dots is needed to be in uniform state in order to obtain sufficient transfer property in a highlight area. When there is an area of high viscosity in the microscopic dots of the molten toner, part of the toner remains on the transfer fixing member and as a result, degradation of reproducibility in a highlight area and contamination of the transfer fixing member occur.

The temperatures of upper layer, lower layer and layer above the paper of the toner are theoretically calculated values obtained from one-dimensional heat transmission simulation using a difference method because it is difficult to measure actual interface temperatures of the toner and the paper.

A method for calculating each temperature by theoretical calculation will be explained below.

The one-dimensional non-steady heat conduction equation is expressed by the following Equation 1 (Fourier's law).

$$\frac{\partial T}{\partial t} = \frac{\lambda}{\rho c} \cdot \frac{\partial^2 T}{\partial x^2} \qquad \text{Equation 1}$$

In Equation 1, "T" represents temperature, "t" represents time, "x" represents distance, "λ" represents heat conductivity, "ρ" represents specific gravity and "c" represents specific heat.

The following difference equation is obtained by space discretization of the above Equation 1.

$$T(x, t+\tau) = T(x, t) + \frac{\lambda\tau}{\rho c h^2}[(T(x-h, t) - (T(x, t)) + (T(x+h, t) - T(x, t))] \qquad \text{Equation 2}$$

In Equation 2, "h" represents a distance between each lattice, "τ" represents a microscopic time, and if the temperature T at three lattice points x−h, x and x+h which are adjacent to each other at a microscopic distance "h" at a time "t" is already known, a temperature T (x, t+τ) after a time "τ" can be obtained from the above Equation 2.

The above Equation 2 is a difference equation within the same substance. The difference equation on a boundary where different substances "a" and "b" are in contact with each other can be obtained similarly by the following Equation 3.

$$T(x, t+\tau) = T(x, t) + \frac{2\tau}{\rho_a c_a h_a + \rho_b c_b h_b}\left[\frac{\lambda_a}{h_a}(T(x-h, t) - (T(x, t)) + \frac{\lambda_b}{h_b}(T(x+h, t) - T(x, t))\right] \qquad \text{Equation 3}$$

Other analysis condition is as follow.

The heat migration in an axis direction and circumferential direction are ignored and the heat migration only in a thickness direction is considered (one-dimensional).

Because the toner layer is formed into a film before contact with the paper during transfer/fixing, the thickness is half, and specific gravity and heat conductivity are 2 times of the toner in form of fine particle. Since it was confirmed in comparative conventional fixing that the toner layer is formed into a film after 0.04 seconds, the values were calculated on an assumption that the thickness, specific gravity and heat conductivity are changed linearly from the beginning.

The temperatures of each part after a given time τ can be calculated by the above calculation method on a basis of the temperatures of fixing belt, fixing roller, pressurizing roller, toner, recording paper and atmosphere right before going into the fixing nip portion as an initial condition at a time t=0.

Meanwhile, the above calculation method is an example for obtaining interface temperatures of the toner and the paper, and the calculation method is not limited to the above method. The above method is an explicit method of difference equation and implicit method of difference equation may also be used, for example. Moreover, it may be extended to two-dimensional for further improvement of calculation accuracy. Furthermore, interface temperature of the toner and the paper may be calculated from various experimental results based on experience instead of heat conduction simulation.

TABLE 1

| | | Initial Temperature (° C.) | | |
|---|---|---|---|---|
| | | Thickness (μm) | Conventional Fixing | Transfer Fixing |
| Fixing Roller | Iron | 5,000 | 160 | 160 |
| | Heat-insulating Ceramic | 2,000 | 160 | 160 |
| Fixing Belt | Polyimide | 100 | 160 | 160 |
| | Silicon Rubber | 100 | 160 | 160 |
| | Fluorine Resin | 10 | 160 | 160 |
| Toner | | 10 | 20 | 160 |
| Paper | | 80 | 20 | 20 |
| Pressurizing Roller | Fluorine Resin | 30 | 20 | 20 |
| | Heat-insulating Ceramic | 2,000 | 20 | 20 |
| | Iron | 5,000 | 20 | 20 |

Figure 6:
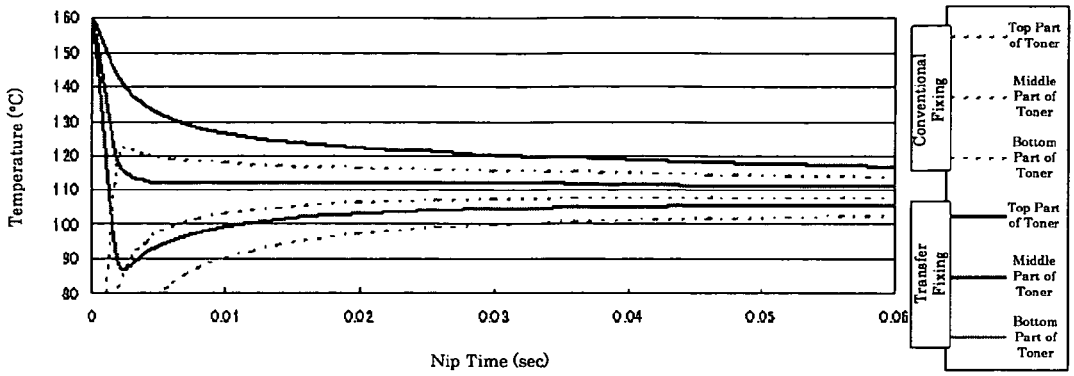
FIG. 6 is a graph showing temperatures of upper layer, lower layer and the layer above the paper of a toner relative to nip time in conventional fixing and transfer fixing.
Figure 6:
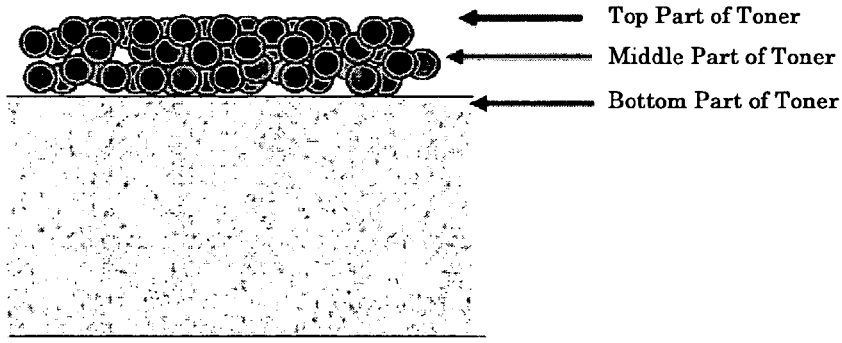

FIG. 6 is the above results expressed by a graph, and the toner is fixed while temperature of the toner layer is lowered as a whole during transfer/fixing. The reverse is true for the conventional fixing, and the toner is fixed while the temperature of the toner layer is raised. The difference is especially significant in the area where nip time is 30 ms or less and it is further notable in the area where nip time is 20 ms or less and nip time of 10 ms to 20 ms is more preferable.

The mechanism of offset occurrence in relation with nip time in comparison with the result of analysis on presence or absence of hot offset occurrence with changing nip time will be examined. Because the lower surface of the toner does not reach the temperature at which the toner is softened and deformed to be fixed on a paper, hot offset occurs as a result within the above nip time range in conventional fixing. In transfer/fixing on one hand, because the temperature of the lower surface of the toner has been raised high enough for the toner to be softened and deformed to be fixed on the paper even in this area, hot offset does not occur.

The toner used for the image forming apparatus of the present invention can be selected accordingly as long as the toner has a main peak in an area of 5,000 to 15,000 molecular weight at least in a molecular weight distribution measured by GPC, the component of 30,000 or more molecular weight is not contained and a value of Mw/Mn is 2 to 6. Examples of the toner include known binder resins.

Examples include styrene or monomers or polymers of substituted styrene such as polyester, polystyrene, poly-p-chlorostyrene, polyvinyl toluene, and the like; styrene copolymers such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymer, and the like.

The following resins may be mixed for use: polymethyl methacrylate, polybutyl methacrylate, polyvinyl chloride, polyvinyl acetate, polyethylene, polypropylene, polyurethane, polyamide, epoxy resin, polyvinyl butyral, polyacrylic resin, rosin, modified rosin, terpene resin, phenol resin, aliphatic or alicyclic hydrocarbon resin, aromatic petroleum resin, chlorinated paraffin, paraffin wax, and the like.

Among these, polyester resin is preferable for obtaining sufficient fixing property. Since the polyester resin basically has an excellent fixing property at low temperatures, it exhibits excellent fixing property at low temperatures when used for heating/fixing device of film-heating type and it also excels in glossiness.

Polyester resin is obtained by condensation polymerization of alcohol and carboxylic acid. Examples of alcohol used in here include diols such as polyethylene glycol, diethylene glycol, triethylene glycol, 1,2-propylene glycol, 1,3-propylene glycol, 1,4-butanediol, neopentyl glycol and 1,4-butenediol, 1,4-bis(hydroxymethyl)cyclohexane, etherificated bisphenols such as bisphenol A, hydrogen-added bisphenol A, polyoxyethylene bisphenol A and polyoxypropylene bisphenol A, bivalent alcohols obtained by substituting the above compounds with saturated or unsaturated hydrocarbon groups of 3 to 22 carbon numbers and other bivalent alcohols.

Furthermore, examples of carboxylic acid used for obtaining polyester resin include maleic acid, fumaric acid, mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, bivalent organic acid monomers obtained by substituting thereof with saturated or unsaturated hydrocarbon group of 3 to 22 carbon numbers, acid anhydride thereof, dimer of lower alkylester and linolenic acid and other bivalent organic acid monomers.

In order to obtain polyester resin used as a binder resin, it is also preferable to use not only polymers of bifunctional monomers such as above, but polymers containing component of polyfunctional monomers of trifunctional or more. Examples of polyvalent alcohol monomers of trivalent or more which are polyfunctional monomers of trifunctional or more include sorbitol, 1,2,3,6-hexanetetrol, 1,4-sorbitan, pentaerythritol, dipentaerythritol, tripentaerythritol, sucrose, 1,2,4-butantriol, 1,2,5-pentantriol, glycerol, 2-methylpropanetriol, 2-methyl-1,2,4-butantriol, trimethyrolethane, trimethyrolpropane, 1,3,5-trihydroxymethylbenzene and others.

Examples of polyvalent carboxylic acid monomers of trivalent or more include 1,2,4-benzenetricarboxylic acid, 1,2,5-benzentricarboxylic acid, 1,2,4-cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl) methane, 1,2,7,8-octanetetracarboxylic acid, enpol trimeric acid and anhydrides thereof, and others.

Moreover, modified polyester may be used as the polyester resin contained as a toner binder. The modified polyester (MPE) is defined as a condition in which binding groups other than functional group and ester bond contained in monomer unit of above-mentioned acids and alcohols exist in the polyester resin, or a condition in which resin components of different compositions are bonded by covalent bonding or ion binding in the polyester resin. Examples of modified polyester include the polyester of which terminals are reacted with compound other than ester bond and in particular, the polyester in which functional groups such as isocyanate group which reacts with acid group and hydroxyl group are introduced into polyester terminals to modify or elongate terminals by further reaction with active hydrogen compound. Furthermore, compounds in which polyester terminals are bonded with each other such as urea-modified polyester, urethane-modified polyester, and the like are also included if the compound contains plural number of active hydrogen groups. In addition, modified polyester in which reactive groups such as double bond are introduced in main chain and graft components of carbon-carbon coupling are introduced in side chain or double bonds are cross-linked with each other by induced radical polymerization are also included (styrene-modified or acryl-modified polyester, and the like). And modified polyester in which resin components of different compositions are copolymerized or reacted with carboxylic acid or hydroxyl group of terminals in main chain of polyester, for example, modified polyester in which silicon resin of which terminals are modified with carboxyl group, hydroxyl group, epoxy group and mercapto group is copolymerized is also included (silicon-modified polyester, etc.).

The molecular weight of resin as a toner binder may be measured as follow. After approximately 1 g of resin particles is weighed by a conical flask, 10 g to 20 g of THF (tetrahydrofran) is added to prepare THF test fluid with a resin density of 5% by mass to 10% by mass. Next, the column inside the heat chamber of 40° C. is stabilized and THF as a solvent is drained in the column of 40° C. at a current speed of 1 ml/minute and 20 μl of the THF test fluid is poured. And the is weight average molecular weight (Mw) of the sample is calculated from the relation between log values of analytical curve made from monodisperse polystyrene standard samples and retention time. The analytical curve is made using the standard polystyrene sample. The monodisperse polystyrene standard sample by Tosoh Corporation with a molecular weight within the range of $2.7\times10^2$ to $6.2\times10^6$ may be used. A refractive index (RI) detector may be used as the detector. Examples of the column include TSKgel, G1000H, G2000H, G2500H, G3000H, G4000H, G5000H, G6000H, G7000H and GMH by Tosoh Corporation.

Figure 7:
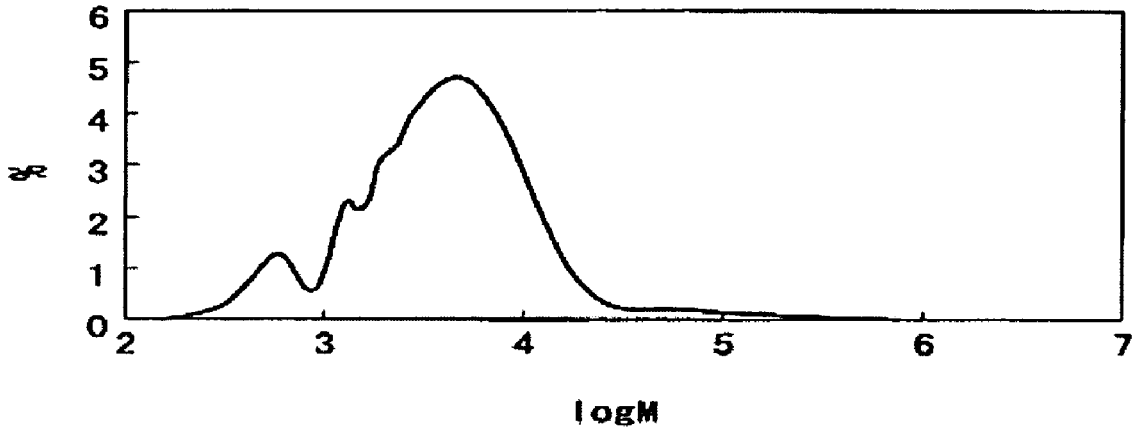
FIG. 7 is a graph showing an example of data measured by GPC.

An exemplary measurement data by GPC is shown in FIG. 7.

The toner used for the present invention forms a dot that is satisfactorily melted with rapid transfer/fixing by having a main peak in an area of 5,000 to 15,000 molecular weight in a molecular weight distribution. When the molecular weight is less than 5,000, heat resistance of fixed image is significantly degraded. Therefore, it is preferably 8,000 or more. When the molecular weight is more than 15,000, thermal responsiveness becomes insufficient though it depends on the set condition of the transfer fixing member, leading to occurrence of components which are not completely melted on the transfer fixing member and anchoring effect on the recording medium would be unsatisfactory. Therefore, the molecular weight is preferably 12,000 or less. Furthermore, by not containing components with a molecular weight of 30,000 or more in the toner, occurrences of components of high viscosity and of gel form in the molten dot are inhibited, thereby achieving excellent transfer property.

As described above, the toner is preferably not to contain components with a molecular weight of 30,000 or more. The content of the components with a molecular weight of 30,000 or more is defined to be 0.05% or less in the present invention because when the content of the components with a molecular weight of 30,000 or more is 0.05% or less, the toner can be said to be not containing components with a molecular weight of 30,000 or more, taking into account the measurement error of GPC.

The value of Mw/Mn of the toner used in the present invention is 2 to 6 and it is preferably 2 to 5. By making the molecular weight distribution sharp, not only viscosity in the molten dot is retained uniformly, but also images of excellent transparency and glossiness can be obtained.

The melting temperature of the toner is preferably 80° C. to 140° C. for the present invention for achieving high speed and energy conservation. When the melting temperature of the toner is less than 80° C., heat-resistant storage property of the images may be degraded, and when it is more than 140° C., it is not preferable in terms of heat effect on the recording medium and energy conservation. Moreover, glass transition temperature (Tg) of the toner is generally 50° C. to 80° C., and preferably 55° C. to 65° C. When it is less than 50° C., heat resistance of the toner may be degraded, and fixation of the toner to the developing unit occurs due to temperature rise in the apparatus. When it is more than 80° C., fixing property at low temperatures may be insufficient.

The plasticizer used for the toner of the present invention is a plasticizer of the resin compatible with the resin when heated.

The melting point (Tm) of the plasticizer is preferably 30° C. or more and less than 120° C., and more preferably 60° C. or more and less than 80° C. for providing excellent heat-resistant storage property because the resin and the plasticizer exist independently (not dissolved) when storing the toner and achieving high-level fixing property at low temperatures because the resin and the plasticizer are dissolved quickly by heat during fixing. When the melting point (Tm) is less than 30° C., heat-resistant storage property is degraded, and when it is 120° C. or more, compatibility during heating becomes insufficient and sufficient change in storage elastic modulus cannot be obtained.

The plasticizer is not particularly limited and may be selected accordingly. Examples include fatty acid ester, aromatic acid ester such as phthalic acid, phosphoric acid ester, maleic acid ester, fumaric acid ester, itaconic acid ester and other ester, ketones such as benzil, benzoin compound, benzoyl compound, hindered phenol compound, benzotriazole compound, aromatic sulfonamide compound, aliphatic amide compound, long chain alcohol, long chain dialcohol, long chain carboxylic acid, long chain dicarboxylic acid, and the like.

Specific examples include dimethyl fumarate, monoethyl fumarate, monobutyl fumarate, monomethyl itaconate, monobutyl itaconate, diphenyl adipate, dibenzyl terephthalate, dibenzyl isophthalate, benzyl, benzoin isopropyl ether, 4-benzoylbiphenyl, 4-benzoyldiphenylether, 2-benzoylnaphthalene, dibenzoylmethane, 4-biphenylcarboxylic acid, stearylstearic acid amide, oleylstearic acid amide, stearin oleic acid amide, octadecanol, n-octyl alcohol, tetracosanoic acid, eicosanic acid, stearic acid, lauric acid, nonadecanoic acid, palmitic acid hydroxyl octanoic acid, docosanoic acid, compounds expressed by General Formulas (1) to (17) disclosed in JP-A No. 2002-105414, and the like.

The plasticizer is preferably contained in the toner in a dispersed condition and dispersion diameter of the plasticizer is preferably 10 nm to 3 μm and more preferably 50 nm to 1 μm in particle diameter in maximum direction, for example.

When the dispersion diameter is less than 10 nm, heat-resistant storage property may be inappropriate due to the increase in contact area between plasticizer and resin. When it is more than 3 μm, the plasticizer is not satisfactorily dissolved with the resin when heated during fixing and fixing property at low temperatures may be degraded.

The method for measuring dispersion diameter of the plasticizer is not particularly limited and may be selected accordingly. For example, after toner is embedded in epoxy resin, cut in ultrathin slices of approximately 100 μm and dyed with ruthenium tetroxide, it is observed by means of a transmission electron microscope (TEM) of 10,000 magnifications, photographs are taken, and the images on those photographs are evaluated. By the above procedure, condition of dispersion of the plasticizer can be observed and the dispersion diameter can be measured. Meanwhile, when it is confirmed that the dispersion element of the plasticizer exists in the particle, it can be determined that the plasticizer is not contained in the toner in a dispersed condition.

Solubility of the plasticizer relative to the organic solvents of 25° C. or less is preferably 1% by mass or less and more preferably 0.1% by mass or less, for example. When the solubility is more than 1% by mass the resin and the plasticizer may be dissolved during manufacturing of the toner.

The solubility of the plasticizer relative to the organic solvents of 60° C. or more is preferably 5% by mass or more and more preferably 20% by mass or more, for example. When the solubility is less than 5% by mass, the plasticizer is not dissolved in the organic solvent by heat and the condition of dispersion of the plasticizer in the toner may be inappropriate.

The solubility of the plasticizer relative to the organic solvents can be obtained by measuring the amount (g) of the plasticizer which is dissolved relative to 100 g of the organic solvent at each measured temperature.

The content of the plasticizer in the toner is preferably 5% by mass to 30% by mass and more preferably 10% by mass to 20% by mass in terms of pursuing fixing property at low temperatures and heat-resistant storage property simultaneously and maintaining properties of the toner such as charging ability, resolution, etc. at high level. When the content is less than 5% by mass, fixing property at low temperatures may be degraded, and when it is more than 30% by mass, area of the plasticizer on a surface of the toner may increase, degrading flowability of the toner.

The crystalline polyester resin used for the toner of the present invention is compatible with the resin when heated. The glass transition temperature (Tg) of the crystalline resin is preferably 60° C. or more and less than 140° C. for providing excellent heat-resistant storage property because the resin and the crystalline polyester resin exist independently (not dissolved) when stored and for achieving high-level fixing property at low temperatures because the resin and the crystalline polyester resin are dissolved quickly by heat during fixing. When the glass transition temperature (Tg) is less than 60° C., heat-resistant storage property is degraded, and when it is 140° C. or more, compatibility during heating becomes insufficient as well as the fixing property at low temperatures of the toner is degraded and sufficient change in storage elastic modulus cannot be obtained.

When pulverization is used for granulating the toner, although conditions are defined for kneading step, heat resistance may be lowered because part of the resin and the crystalline polyester resin is dissolved, and therefore, glass transition temperature (Tg) of the crystalline resin alone in this case is preferably 100° C. or more.

The crystalline polyester resin contains the structure expressed by —OCOC—R—COO—$(CH_2)$n- (In the formula, "R" represents a straight-chain unsaturated aliphatic group having a carbon number of 2 to 20 and "n" represents an integer of 2 to 20) which includes polyvalent alcohol units and carboxylic acid units in the amount of 60 mol % of the entire ester bond at least in the whole resin. Meanwhile, "R" preferably represents a straight-chain, unsaturated aliphatic bivalent carboxyl residue having a carbon number of 2 to 20 and more preferably represents a straight-chain unsaturated aliphatic group having a carbon number of 2 to 4 in the above formula. "n" is preferably an integer of 2 to 6.

Specific examples of the straight-chain unsaturated aliphatic group include straight-chain unsaturated aliphatic groups derived from straight-chain unsaturated bivalent carboxylic acid such as maleic acid, fumaric acid, 1,3-n-propendicarboxylic acid, 1,4-n-butendicarboxylic acid, and the like.

The above "$(CH_2)$n" represents a straight-chain aliphatic bivalent alcohol residue. Specific examples of straight-chain aliphatic bivalent alcohol residue in this case include the ones derived from straight-chain aliphatic bivalent alcohol such as ethylene glycol, 1,3-propylene glycol, 1,4-butanediol, 1,6-hexanediol, and the like. Because the crystalline polyester resin uses straight-chain, unsaturated aliphatic dicarboxylic acid units as carboxylic acid units, crystalline structure is easily formed compared with the case where aromatic dicarboxylic acid units are used.

The crystalline polyester resin can be manufactured by normal polycondensation of (1) polyvalent carboxylic acid units formed by straight-chain, unsaturated aliphatic bivalent carboxylic acid or reactive derivatives thereof (acid anhydride, lower alkyl ester acid halide having a carbon number of 1 to 4, etc.) and (2) polyvalent alcohol units formed by straight-chain aliphatic diol. In this case, polyvalent carboxylic acid units may include a small amount of other polyvalent carboxylic acid units as necessary. The polyvalent carboxylic acid units in this case contains (1) unsaturated aliphatic bivalent carboxylic acid units having branched chain and (2) saturated aliphatic polyvalent carboxylic acid units such as saturated aliphatic bivalent carboxylic acid or saturated aliphatic trivalent carboxylic acid, as well as (3) aromatic polyvalent carboxylic acid units such as aromatic bivalent carboxylic acid or aromatic trivalent carboxylic acid, etc. The content of these polyvalent carboxylic acid units is generally 30 mol % or less and preferably 10 mol % or less relative to the whole amount of carboxylic acid and it is adjusted within the range in which obtained polyester remains in crystal state.

Specific examples of polyvalent carboxylic acid units which can be added accordingly include bivalent carboxylic acid units such as malonic acid, succinic acid, glutaric acid, adipic acid, suberic acid, sebacic acid, citraconic acid, phthalic acid, isophthalic acid, terephthalic acid; and polyvalent carboxylic acid units of trivalent of more such as trimellitic anhydride, 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, 1,2,7,8-octanetetracarboxylic acid, and the like.

The polyvalent alcohol units may include a small amount of aliphatic branched-chain bivalent alcohol units or cyclic bivalent alcohol units as well as polyvalent alcohol units of trivalent or more accordingly. The content is 30 mol % or less and preferably 10 mol % or less relative to the whole amount of alcohol units and it is adjusted within the range in which obtained polyester remains in crystal state.

Examples of polyvalent alcohol units added accordingly include 1,4-bis(hydroxymethyl)cyclohexane units, polyethylene glycol units, bisphenol A ethyleneoxide adduct units, bisphenol A propyleneoxide adduct units, glycerin units, and the like.

The molecular weight distribution of crystalline polyester resin is preferably sharp in terms of fixing property at low temperatures, and the molecular weight is preferable to be relatively low. The molecular weight of crystalline polyester resin, in the molecular weight distribution of o-dichlorobenzene soluble portion by GPC, is preferably 5,500 to 6,500 in weight average molecular weight (Mw), 1,300 to 1,500 in number average molecular weight (Mn) and 2 to 5 in Mw/Mn ratio.

The glass transition temperature (Tg) and softening temperature [T(F1/2)] of the crystalline polyester resin is preferably low within the range in which heat-resistant storage property of the toner is not degraded, and the glass transition temperature is generally 80° C. to 140° C. and preferably 80° C. to 125° C., and the softening temperature is generally 80° C. to 140° C. and preferably 80° C. to 125° C. When the glass transition temperature and softening temperature are more than the above range, fixing property at low temperatures of the toner is degraded because lower limit of the fixing temperature of the toner is increased.

Acid value of the toner is preferably 30 mgKOH/g to 50 mgKOH/g. The compatibility with the recording medium which is mainly paper increases by having acid values and satisfactory anchor effect is exhibited even when nip time is short. When the acid value is less than 30 mgKOH/g, defects of transfer/fixing tend to occur, and when the acid value is more than 50 mgKHO/g, negative electric property of the toner is enhanced, leading to electrostatic defects such as charge up inside the developing device, occurrence of transfer dust during primary transfer to an intermediate transfer member, etc.

Moreover, toner binder and colorant are preferably containing waxes. The known waxes can be used and examples include vegetable waxes such as rice wax, japan wax, and the like, animal waxes such as yellow beeswax, mineral waxes such as montan wax, petroleum waxes such as paraffin wax, and other polyolefin waxes (polyethylene wax, polypropylene wax); long-chain hydrocarbon (paraffin wax, Sasol Wax) acid amide, synthesized ester wax, and the like. Among these, the most preferable waxes are vegetable waxes such as candelilla wax, carnauba wax, rice wax and yellow beeswax. These vegetable waxes are most favorable because they are appropriately dispersed with polyester resin and the relation between the melting point of the wax which is 60°C. to 110°C. and the glass transition temperature (Tg) and softening point of the polyester resin is effective for preventing effusion.

The melting point of waxes (Tw) is generally 40° C. to 160° C. and it is preferably equal to or more than Tg of toner binder resin (Tgt) and equal to or less than melting temperature of the toner binder (Tmt). The waxes having a melting point of less than Tgt may have an adverse effect on heat-resistant storage property, and the waxes having a melting point of more than Tmt do not produce effects on cold offset at low temperatures during fixing. Furthermore, melting viscosity of the waxes is preferably 5 cps to 1,000 cps and more preferably 10 cps to 100 cps as measured at a temperature 20° C. higher than the melting point. The waxes having a melting viscosity of more than 1,000 cps do not exhibit appropriate improving effect for hot offset resistance and fixing property at low temperatures. The content of wax in the toner is preferably 5% by mass to 40% by mass in general and more preferably 5% by mass to 30% by mass. When the content is more than 30% by mass, wax tends to become exposed on a surface of the toner and may develop a problem of flowability of the toner. The molecular weight of vegetable waxes is preferably 400 to 5,000 in weight average molecular weight measured by GPC by Waters. When the molecular weight of vegetable waxes is more than 5,000, dispersion particle diameter of the wax is increased possibly causing the degradation of transparency, another carrier contamination and adherence of photoconductors. When it is less than 400, heat-resistant storage property of the toner may be degraded. The dispersion particle diameter of the wax reaches 0.1 μm to 1.5 μm with an appropriate dispersion property of the wax with polyester resin.

Inorganic particles can be suitably used for the toner used for the present invention as an external additive for enhancing flowability, developing property and transfer property. The primary particle diameter of the inorganic particles is preferably 5 nm to 200 nm and more preferably 10 nm to 150 nm. The specific surface by BET method is preferably 20 $m^2/g$ to 500 $m^2/g$. The content of the inorganic particles is preferably 0.01% by mass to 5% by mass and more preferably 0.01% by mass to 2.0% by mass of the toner. Specific examples of the inorganic particles include silica, alumina, titanium oxide, barium titanate, magnesium titanate, calcium titanate, strontium titanate, zinc oxide, tin oxide, silicate sand, clay, mica, silicic pyroclastic rock, diatomaceous earth, chromic oxide, cerium oxide, colcothar, antimony trioxide, magnesium oxide, zirconium oxide, barium sulfate, barium carbonate, calcium carbonate, silicon carbide and silicon nitride. And others also included are high molecule particles such as polystyrene, methacrylic acid ester or acrylic acid ester copolymer obtained by soap-free emulsion polymerization, suspension polymerization or dispersion polymerization, silicon, benzoguanamine, or nylon obtained by polycondensation and polymer particles derived from heat-curable resin.

It is possible to prevent degradation of flowability or charging ability even under a condition of high moisture by applying such fluidizers on a surface of the toner to improve hydrophobicity. Preferred examples of surface-processing agent include silane coupling agent, silylation agent, silane coupling agent having alkyl fluoride group, organic titanate coupling agent, aluminum coupling agent, silicon oil and modified silicon oil. Examples of cleaning property improving agent for removing residual developer on the photoconductors or primary transfer mediums after transferring include aliphatic acid metal salt such as zinc stearate, calcium stearate and stearic acid and polymer particles manufactured by soap-free emulsion polymerization such as polymethylmethacrylate particle or polystyrene particle. The particle size distribution of the polymer particles is preferably small and the volume average particle diameter of the polymer particles is preferably 0.01 μm to 1 μm.

Other components are not particularly limited and may be selected accordingly. Examples thereof include colorants, releasing agents, charge controlling agents, inorganic particles, flowability improvers, cleaning ability improvers, magnetic materials, metal soaps, and the like.

The colorants are not particularly limited and may be selected from known dyes and pigments accordingly. Examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Hello Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and the like. These may be used alone or in combination.

The content of the colorant in the toner is not particularly limited and may be adjusted accordingly and it is preferably 1% by mass to 15% by mass and more preferably 3% by mass to 10% by mass.

It the content is less than 1% by mass, tinctorial power of the colorant is degraded, and if the content is more than 15% by mass, a dispersion failure of pigments in the toner may occur, resulting in degradation of tinctorial power or electric properties of the toner.

The colorant may be used as a master batch being combined with a resin. Such resin is not particularly limited and may be selected from known resins accordingly. Examples thereof include polymers of styrene or substituted styrene, styrene copolymer, polymethyl methacrylate, polybuthyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, paraffin wax, and the like. These may be used alone or in combination.

Examples of polymers of styrene or substituted styrenes include polyester resin, polystyrene, poly-p-chlorostyrene, polyvinyl toluene, and the like. Examples of styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic ester copolymer, and the like.

The master batch can be obtained by mixing and kneading a resin for master batch and the colorant with high shear force. To improve interaction between colorant and resin, it is preferable to add an organic solvent. In addition, the "flushing process" in which a wet cake containing colorant can be applied directly, is preferable because it requires no drying. In the flushing process, a water-based paste containing colorant and water is mixed and kneaded with the resin and an organic solvent so that the colorant moves towards the resin, and that water and the organic solvent are removed. The materials are preferably mixed and kneaded using a triple roll mill and other high-shear dispersing devices.

The charge controlling agent is not particularly limited, and may be selected from known agents accordingly. Examples of charge controlling agent include nigrosine dye, triphenylmethane dye, chlome-containing metal complex dye, acid chelate pigment, rhodamine dye, alkoxy amine, quaternary ammonium salt such as fluoride-modified quaternary ammonium salt, alkylamide, phosphoric simple substance or compound thereof, tungsten simple substance or compound thereof, fluoride activator, salicylic acid metallic salt, salicylic acid derivative metallic salt, and the like. These may be used alone or in combination.

The charge controlling agent may be selected from the commercially available products. Specific examples thereof include Bontron 03 of nigrosin dye, Bontron P-51 of a quaternary ammonium salt, Bontron S-34 of metal-containing azo dye, Bontron E-82 of an oxynaphthoic acid metal complex, Bontron E-84 of a salicylic acid metal complrex and Bontron E-89 of a phenol condensate by Orient Chemical Industries, Ltd.; TP-302 and TP-415 of a quaternary ammonium salt molybdenum metal complex by Hodogaya Chemical Co.; Copy Charge PSY VP2038 of a quaternary ammonium salt, Copy Blue PR of a triphenylmethane derivative and Copy Charge NEG VP2036 and Copy Charge NX VP434 of a quaternary ammonium salt by Hoechst Ltd.; LRA-901, and LR-147 of a boron metal complex by Japan Carlit Co., Ltd.; copper phthalocyanine, perylene, quinacridone, azo pigment, and other high-molecular mass compounds having functional group of sulfonic acid, carboxyl, quaternary ammonium salt, or the like.

The content of the charge controlling agent in the toner depends on the type of binder resin, presence or absence of external additives, and the dispersion process selected to use and there is no defined prescription. However, the content of charge controlling agent is preferably 0.1 part by mass to 10 parts by mass and more preferably 0.2 part by mass to 5 part by mass relative to 100 parts by mass of the binder resin, for example. When the content is less than 0.1 parts by mass, charge may not be appropriately controlled. If the content is more than 10 parts by mass, charge ability of the toner becomes excessively large, which lessens the effect of charge controlling agent itself and increases electrostatic attraction force with a developing roller, leading to developer flowability or image density degradation.

The toner of the present invention can be manufactured by means of know methods such as suspension polymerization, emulsion polymerization, melting suspension, and the like. For example, the toner can be obtained by emulsifying and/or dispersing a solution and/or dispersion liquid of toner material in an aqueous medium to prepare an emulsion and/or dispersion liquid and granulating the toner.

Moreover, the toner can be manufactured by using a spray granulation method using piezo element or vibration olifice.

The temperature at which the toner of the present invention is manufactured is preferably 10° C. to 80° C. and more preferably 20° C. to 60° C. When the manufacturing temperature is more than 80° C., constituent materials are dissolved by heat and simultaneous pursuit of fixing property at low temperatures and heat-resistant storage property may be impossible.

The volume average particle diameter of the toner used for the present invention is preferably 3 μm to 10 μm and more preferably 4 μm to 6 μm for obtaining high quality images and reducing gaps between toner particles in the toner image on the transfer fixing member. Furthermore, a ratio of volume average particle diameter (Dv) to number average particle diameter (Dp), (Dv/Dp) is preferably 1.05 to 1.25 and more preferably 1.05 to 1.15. The average circularity of the toner is preferably 0.90 to 1.00 and more preferably 0.94 to 0.97. By using the toner as described above, high quality images of stable fixing property can be attained.

The developer used for the image forming apparatus of the present invention can be suitably used for image forming by various known electrophotographic methods such as magnetic one-component developing method, nonmagnetic one-component developing method and two-component developing method, and can be used particularly suitably for toner container, process cartridge, image forming apparatus and image forming method of the present invention as described below.

The nip time, the time it takes for a recording medium to pass through the transfer fixing nip is set at 30 ms or less in the present invention, making high-speed fixing possible and the present invention is applicable for high-speed printing. Moreover, because the nip time is set at 30 ms or less, hot offset can be inhibited by making toner layer to be separated from the transfer fixing member while being temporarily quenched by contact with the recording medium during transfer/fixing.

Preferably, because the toner image on the intermediate transfer member is secondarily transferred to a roll-shaped transfer fixing member and then the toner image on the transfer fixing member is tertiarily transferred to a recording medium in the present invention and in addition, because intermediate transfer member exists between the transfer fixing member and image bearing member, it becomes possible to have a path enough to prevent heating of image bearing member. Though a cooling device may be installed in some cases, it is also possible to have enough space for the purpose above.

Preferably, because the toner image on the intermediate transfer member is secondarily transferred to a belt-shaped transfer fixing member and then the toner image on the transfer fixing member is tertiarily transferred to a recording medium in the present invention and in addition, because intermediate transfer member exists between the transfer fixing member and image bearing member, it becomes possible to have a path enough to prevent heating of image bearing member. Though a cooling device may be installed in some cases, it is also possible to have enough space for the purpose above.

Preferably, the transfer fixing member is employed as an intermediate transfer member, and the toner image formed on the image bearing member is primarily transferred to the transfer fixing member and the toner image on the transfer fixing member is then secondarily transferred to a recording medium in the present invention. Because of this, when the toner image on the transfer fixing member is heated by a heating unit, the heat from the transfer fixing member is transmitted to the recording medium only by a fixing nip, and most of the heat is used for heating of the toner image, thereby achieving energy conservation by melting the toner effectively, and shortening the warm-up time by maintaining the heating temperature of the heating unit low.

Furthermore, by the present invention, dot conditions in which the toner is melted satisfactorily can be formed because the toner binder has a main peak in an area of 5,000 to 15,000 molecular weight in a molecular weight distribution measured by GPC. And in addition, there is no need to contain components of 30,000 or more molecular weight due to rare occurrence of hot offset and components of high viscosity or in gel form do not occur in the molten dot, thereby achieving excellent transfer property. Moreover, because a value of weight-average molecular weight (Mw)/number average molecular weight (Mn), Mw/Mn is 2 to 6, not only viscosity in the molten dot is maintained uniformly, but also images of excellent glossiness can be obtained by making the molecular weight distribution sharp.

And because the toner is satisfactorily heated and melted on the transfer fixing member and microscopic difference in viscosity in the heated and molten toner is small, anchoring effect of the toner which comes in contact with recording mediums is produced sufficiently even for highlight images and appropriate transfer property can be obtained. It is possible for the image forming apparatus, which achieves high-speed fixing and energy conservation and exhibits density gradient by image modulation at an image resolution of 600 dpi or more in particular, to obtain high quality and high stablility images even in highlight area and high density area.

Preferably, the toner binder used for the present invention contains at least polyester resin, thereby obtaining achieving excellent fixing property at low temperatures and appropriate transparency and glossiness.

Since the melting temperature of the toner is preferably 80° C. to 140° C. and a surface temperature of the transfer fixing member relative to the melting temperature of the toner is defined in a constant range in the present invention, it is preferable in terms of heat-resistant storage property of images, effect of heat on recording mediums or energy conservation, temperature rise of the intermediate transfer member is prevented, thereby making high-speed fixing at low temperatures possible.

Since the preferred glass transition temperature of the toner (Tgt) is 50° C. to 80° C. in the present invention, heat resistance of the toner image on the recording medium can be improved.

Moreover, since the acid value of the toner is preferably high in the present invention, transfer property can be improved by increasing affinity of the toner relative to the recording medium.

Since the content of releasing agents in the toner is preferably 5% by mass to 40% by mass and the melting point of the releasing agent is set within the range of the glass transition temperature and melting temperature of the toner, releasing property of the transfer fixing member is improved and oil coating to the transfer fixing member becomes unnecessary.

Since the preferred volume average particle diameter (Dv) of the toner is 3 μm to 10 μm, preferred ratio of the volume average particle diameter (Dv) to the number average particle diameter (Dp), Dv/Dp is 1.05 to 1.25 and preferred circularity is 0.90 to 1.00 in the present invention, images of higher quality can be obtained by smaller diameter of the toner, and the gap between toner particles in the toner image on the transfer fixing member becomes small, thereby making stable fixing possible.

Since the toner is preferably containing a plasticizer of a resin which is soluble with the resin when heated in the present invention, it becomes possible to further improve fixing property at low temperatures while maintaining heat resistance.

Since the toner is preferably containing a crystalline polyester resin which is soluble with the resin when heated in the present invention, it becomes possible to further improve fixing property at low temperatures.

Since the toner is preferably manufactured by granulation after emulsifying and/or dispersing a solution and/or dispersion liquid of toner material in an aqueous medium to prepare an emulsion and/or dispersion liquid in the present invention, kneading step in which the material is heated once in conventional pulverization method is not included and the toner can be manufactured without dissolving constituent material.

The toner is preferably manufactured by granulation after spraying a solution and/or dispersion liquid of toner material in the present invention, kneading step in which the material is heated once in conventional pulverization method is not included and the toner can be manufactured without dissolving constituent material.

EXAMPLES

The present invention will be explained in detail referring to Examples and Comparative Examples below and the following Examples and Comparative Examples should not be construed as limiting the scope of this invention.

[Preparation of Toners A to D]

The polyester resins A to D which exhibit molecular weight distributions, glass transition temperatures and melting temperatures as shown in Table 2 were obtained.

TABLE 2

| | Tg (° C.) | Tm (° C.) | Molecular Weight Peak | Molecular Weight Components of 30,000 or more | Mw/Mn | Acid Value |
|---|---|---|---|---|---|---|
| Polyester Resin A | 63.6 | 106.1 | 8,900 | 0% | 4.5 | 38.1 |
| Polyester Resin B | 75.9 | 107.8 | 14,000 | 0% | 2.0 | 32.5 |
| Polyester Resin C | 65.2 | 106.2 | 8,300 | 2% | 9.8 | 34.5 |
| Polyester Resin D | 62.5 | 140.8 | 21,000 | 20% | 11.6 | 32.5 |

Next, for performing evaluation of experiment, 5 parts by mass of carbon black pigment and 20 parts by mass of a mixture of carnauba wax and rice wax (by Cera Rica Noda Co., Ltd., melting point: 84° C.) as a releasing agent were melt-kneaded in 100 parts by mass of each polyester resin A to D. After each mixture was pulverized and classified by means of a jet mill to have a weight average particle diameter of 5 μm to 6 μm, a ratio of volume average particle diameter (Dv) to number average particle diameter (Dp), Dv/Dp of 1.05 to 1.15 and an average circularity of 0.90 to 0.93, external additives were adjusted and mixed to provide appropriate flowability, transfer property and charging ability to obtain toners A to D.

[Preparation of Toners E to H]

The toners E to H were prepared similarly to toners A to D except for using 5 parts by mass of ester wax (by NOF Corp., melting point: 82° C.) as a releasing agent.

[Preparation of Toner I]

Preparation of Solution and/or Dispersion Liquid of Toner Material

Synthesis of Native Polyester (Low-Molecular Polyester)

In a reaction vessel equipped with condenser tube, stirrer, and nitrogen inlet tube, 67 parts by mass of bisphenol A ethylene oxide dimolar adduct, 84 parts by mass of bisphenol A propylene oxide trimolar adduct, 274 parts by mass of terephthalic acid and 2 parts by mass of dibutyl tin oxide were placed, and the reaction was performed under normal pressure at 230° C. for 8 hours, and under a reduced pressure of 10 mmHg to 15 mmHg for 5 hours to obtain a synthesized native polyester.

The obtained native polyester had a Tg of 58.2° C., a Tm of 96.4° C., a molecular weight peak of 5,600, 0% of components with a molecular weight of 3,000 or more and Mw/Mn of 4.2.

Preparation of Masterbatch (MB)

1,000 parts by mass of water, 540 parts by mass of carbon black ("Printex 35" by Degussa AG, DBP oil absorption amount=42 ml/100 g, pH=9.5) and 1,200 parts by mass of the native polyester were mixed in a Henschel mixer (by Mitsui Mining Co., Ltd.). Then the mixture was kneaded at 150° C. for 30 minutes using a double roll, and subjected to rolling-cooling and pulverized with a pulverizer (by Hosokawa Micron Corp.) to prepare a masterbatch.

Preparation of Dispersion Liquid of Plasticizer 200 parts by mass of polyethylene glycol diester (by Matsumoto Yushi-Seiyaku Co., Ltd., melting point: 66° C.) as a plasticizer, 400 parts by mass of polyester resin and 800 parts by mass of ethyl acetate were mixed and the mixture was then circulated for 5 minutes using a bead mill ("Ultra Visco Mill" by Aimex Co., Ltd.) with a condition of a liquid feed rate of 1 kg/hr, disc circumferential velocity of 6 m/s and 0.5 mm zirconia beads packed to 80% by volume to disperse plasticizer and a dispersion of plasticizer was prepared.

Preparation of Solution and/or Dispersion Liquid of Toner Material

In a beaker, 75 parts by mass of the native polyester, 130 parts by mass of ethyl acetate and 100 parts by mass of the dispersion liquid of plasticizer were introduced, stirred and dissolved. Next, 10 parts by mass of carnauba wax [molecular weight=1,800, acid value=2.5 and degree of penetration=1.5 mm (40° C.)] and 10 parts by mass of the masterbatch were introduced and a law material solution was prepared by using a bead mill ("Ultra Visco Mill" by Aimex Co., Ltd.) with a condition of a liquid feed rate of 1 kg/hr, disc circumferential velocity of 6 m/s, 0.5 mm zirconia beads packed to 80% by volume and 3 passes to prepare a solution and/or dispersion liquid of toner material.

Preparation of Aqueous Medium Phase 306 parts by mass of ion exchange water, 265 parts by mass of 10% by mass suspension liquid of tricalcium phosphate and 0.2 parts by mass of sodium dodecylbenzene sulfonate were stir-mixed and dissolved uniformly to prepare an aqueous medium phase.

Preparation of Emulsified and/or Dispersed Liquid 150 parts by mass of the aqueous medium phase was put in a container and stirred by using a TK homomixer (by Primix Corp.) with a rotating speed of 12,000 rpm. Next, 100 parts by mass of the solution and/or dispersion liquid of toner material was then added to the aqueous medium phase and mixed for 10 minutes to prepare an emulsified and/or dispersed liquid (emulsion slurry).

Removal of Organic Solvent 100 parts by mass of the emulsion slurry was introduced in a flask equipped with stirrer and thermometer and the solvent was removed at 30° C. for 12 hours while stirring with a stirring circumferential velocity of 20 m/min.

Washing and Drying

After filtering 100 parts of the dispersion slurry under the reduced pressure, 100 parts of ion exchange water was added to a filter cake and filtered after mixing by using a TK homomixer at a rotating speed of 12,000 rpm for 10 minutes. 300 parts by mass of ion exchange water was added to the obtained filter cake and filtered twice after mixing by using a TK homomixer at a rotating speed of 12,000 rpm for 10 minutes. 20 parts by mass of 10% by mass solution of sodium hydroxide was added to the obtained filter cake and filtered under a reduced pressure after mixing by using a TK homomixer at a rotating speed of 12,000 rpm for 30 minutes. 300 parts by mass of ion exchange water was added to the obtained filter cake and filtered after mixing by using a TK homomixer at a rotating speed of 12,000 rpm for 10 minutes. 300 parts by mass of ion exchange water was added to the obtained filter cake and filtered twice after mixing by using a TK homomixer at a rotating speed of 12,000 rpm for 10 minutes. 20 parts by mass of 10% by mass hydrochloric acid was further added to the obtained filter cake and filtered after mixing by using a TK homomixer at a rotating speed of 12,000 rpm for 10 minutes. Finally, 300 parts by mass of ion exchange water was added to the obtained filter cake and filtered twice after mixing by using a TK homomixer at a rotating speed of 12,000 rpm for 10 minutes to obtain a final filter cake.

The filter cake was then dried by means of a circulating air dryer at 45° C. for 48 hours and sieved through a sieve of 75 μm mesh to obtain a toner-base particle A. The volume average particle diameter of the obtained toner was 5.3 μm, a ratio of volume average particle diameter (Dv) to number average particle diameter (Dp), Dv/Dp was 1.15 and degree of circularity was 0.98. Furthermore, external additives were adjusted and mixed in order to provide appropriate flowability, transfer property and charging ability to obtain toner I.

[Preparation of Toner J]

The dispersion liquid of plasticizer used for preparation of toner I was changed to the following dispersion liquid of crystalline polyester resin.

Synthesis of Crystalline Polyester Resin A 4,000 g of a composition consist of fumaric acid (mol ratio 88.6), succinic acid (mol ratio 4.9), trimellitic anhydride (mol ratio 6.5) and 1.4 butandiol (mol ratio 100) and 4 g of hydroquinone were put in a round-bottom 4-necked flask of 5L equipped with thermometer, stirrer, condenser and nitrogen inlet tube. The flask was set in a mantle heater, the temperature of the flask was increased while inside of the flask is maintained in a condition of inactive atmosphere by introducing nitrogen gas from the nitrogen inlet tube. The reaction was performed at 8.3 kPa for 1 hour after the reaction performed at 160° C. for 5 hours and then at 200° C. for 1 hour to obtain a crystalline polyester.

The crystalline polyester resin A had a glass transition temperature of 118° C. and a molecular weight peak of 6,400.

Preparation of Dispersion Liquid of Crystalline Polyester Resin 200 parts by mass of crystalline polyester resin A, 400 parts by mass of polyester resin and 800 parts by mass of ethyl acetate were mixed and the mixture was then circulated for 5 minutes by using a bead mill ("Ultra Visco Mill" by Aimex Co., Ltd.) with a condition of a liquid feed rate of 1 kg/hr, disc circumferential velocity of 6 m/s and 0.5 mm zirconia beads packed to 80% by volume to disperse crystalline polyester to prepare a dispersion liquid of crystalline polyester.

The toner base particle J was obtained similarly to the toner base particle I except for using the above dispersion liquid of crystalline polyester resin. The toner base particle J had a volume average particle diameter of 5.5 μm, a ratio of volume average particle diameter (Dv) to number average particle diameter (Dp), Dv/Dp of 1.17 and a degree of circularity of 0.98. External additives were further adjusted and mixed to provide appropriate flowability, transfer property and charging ability to obtain toner J.

[Preparation of Toner K]

In a beaker, 100 parts by mass of styrene acrylic copolymer, (Tg: 59.2° C., acid value: 30, molecular weight peak: 11,000, Mw/Mn: 4.5) and 130 parts by mass of ethyl acetate were introduced, stirred and dissolved. Next, 7 parts by mass of carnauba wax [molecular weight=1,800, acid value=2.5 and degree of penetration=1.5 mm (40° C.)] and 10 parts by mass of the masterbatch were introduced and a law material solution was prepared by using a bead mill ("Ultra Visco Mill" by Aimex Co., Ltd.) with a condition of a liquid feed rate of 1 kg/hr, disc circumferential velocity of 6 m/s, 0.5 mm zirconia beads packed to 80% by volume and 3 passes to prepare a solution and/or dispersion liquid of toner material.

The solution and/or dispersion liquid of toner material was sprayed and was subject to granulation by means of a piezo delivery spray drier to obtain toner base particle K. The toner baser particle K had a volume average particle diameter of 5.5 μm, a ratio of volume average particle diameter (Dv) to number average particle diameter (Dp), Dv/Dp of 1.05 and a degree of circularity of 0.99. External additives were further adjusted and mixed to provide appropriate flowability, transfer property and charging ability to obtain toner K.

[Preparation of Toner L]

<Adhesive Base Material Production Step>

Preparation of Solution and/or Dispersion Liquid of Toner Material

Synthesis of Native Polyester (Low-Molecular Polyester)

In a reaction vessel equipped with condenser tube, stirrer, and nitrogen inlet tube, 67 parts by mass of bisphenol A ethylene oxide dimolar adduct, 84 parts by mass of bisphenol A propylene oxide trimolar adduct, 274 parts by mass of terephthalic acid and 2 parts by mass of dibutyl tin oxide were placed and the reaction was performed under normal pressure at 230° C. for 8 hours, and under a reduced pressure of 10 mmHg to 15 mmHg for 5 hours to obtain a synthesized native polyester.

The obtained native polyester had a molecular weight peak of 5,600 and a glass transition temperature, Tg of 58° C.

Preparation of Masterbatch (MB)

1,000 parts by mass of water, 540 parts by mass of carbon black ("Printex 35" by Degussa AG, DBP oil absorption amount=42 ml/100 g, pH=9.5) and 1,200 parts by mass of the native polyester were mixed by means of a Henschel mixer (by Mitsui Mining Co., Ltd.). Then the mixture was kneaded at 150° C. for 30 minutes using a double roll, subjected to rolling-cooling and pulverized by means of a pulverizer (by Hosokawa Micron Corp.) to prepare a masterbatch.

Synthesis of Prepolymer

In a reaction vessel equipped with condenser tube, stirrer, and nitrogen inlet tube, 682 parts by mass of bisphenol A ethylene oxide dimolar adduct, 81 parts by mass of bisphenol A propylene oxide dimolar adduct, 283 parts by mass of terephthalic acid, 22 parts by mass of trimellitic anhydride and 2 parts by mass of dibutyl tin oxide were placed and the reaction was performed under normal pressure at 230° C. for 8 hours and under a reduced pressure of 10 mmHg to 15 mmHg for 5 hours to obtain a synthesized intermediate polyester.

The obtained intermediate polyester had a number average molecular weight (Mn) of 2,100, a weight average molecular weight (Mw) of 9,600, a glass-transition temperature (Tg) of 55° C., an acid value of 0.5 and a hydroxyl value of 49.

In a reaction vessel equipped with condenser tube, stirrer, and nitrogen inlet tube, 411 parts by mass of the intermediate polyester, 89 parts by mass of isophorone diisocyanate and 500 parts by mass of ethyl acetate were placed and the reaction was performed at 100° C. for 5 hours to obtain a synthesized prepolymer (a polymer capable of reacting with the active hydrogen group-containing compound).

The free isocyanate content of the obtained prepolymer was 1.60% by mass and a solid density (at 150° C., after leaving unattended for 45 minutes) of the prepolymer was 50% by mass.

Synthesis of Ketimine (Active Hydrogen Group-containing Compound)

Into a reaction vessel equipped with stirrer and thermometer, 30 parts by mass of isohorone diamine and 70 parts by mass of methyl ethyl ketone were introduced and the reaction was performed at 50° C. for 5 hours to obtain a synthesized ketimine compound (active hydrogen group-containing compound).

The amine value of ketimine compound (active hydrogen group-containing compound) was 423.

Preparation of Aqueous Medium Phase 306 parts by mass of ion exchange water, 265 parts by mass of 10% by mass suspension liquid of tricalcium phosphate and 0.2 parts by mass of sodium dodecylbenzene sulfonate were stir-mixed and dissolved uniformly to prepare an aqueous medium phase.

Preparation of Emulsified and/or Dispersed Liquid 150 parts by mass of the aqueous medium phase was put in a container and stirred by using a TK homomixer (by Primix Corp.) with a rotating speed of 12,000 rpm. Next, 100 parts by mass of the solution and/or dispersion liquid of toner material was then added to the aqueous medium phase and mixed for 10 minutes to prepare an emulsified and/or dispersed liquid (emulsion slurry).

Removal of Organic Solvent 100 parts by mass of the emulsion slurry was introduced in a flask equipped with stirrer and thermometer and the solvent was removed at 30° C. for 12 hours while stirring with a stirring circumferential velocity of 20 m/min.

Washing and Drying

After filtering 100 parts by mass of the dispersion slurry under the reduced pressure, 100 parts by mass of ion exchange water was added to a filter cake and filtered after mixing by using a TK homomixer at a rotating speed of 12,000 rpm for 10 minutes. 300 parts by mass of ion exchange water was added to the obtained filter cake and filtered twice after mixing by using a TK homomixer at a rotating speed of 12,000 rpm for 10 minutes. 20 parts by mass of 10% by mass solution of sodium hydroxide was added to the obtained filter cake and filtered under a reduced pressure after mixing by using a TK homomixer at a rotating speed of 12,000 rpm for 30 minutes. 300 parts by mass of ion exchange water was added to the obtained filter cake and filtered after mixing by using a TK homomixer at a rotating speed of 12,000 rpm for 10 minutes. 300 parts by mass of ion exchange water was added to the obtained filter cake and filtered twice after mixing by using a TK homomixer at a rotating speed of 12,000 rpm for 10 minutes. 20 parts by mass of 10% by mass hydrochloric acid was further added to the obtained filter cake and filtered after mixing by using a TK homomixer at a rotating speed of 12,000 rpm for 10 minutes. Finally, 300 parts by mass of ion exchange water was added to the obtained filter cake and filtered twice after mixing by using a TK homomixer at a rotating speed of 12,000 rpm for 10 minutes to obtain a final filter cake.

The obtained final filter cake was then dried by means of a circulating air dryer at 45° C. for 48 hours and sieved through a sieve of 75 μm mesh to obtain a toner-base particle L. The volume average particle diameter of the obtained toner was 5.5 μm, a ratio of volume average particle diameter (Dv) to number average particle diameter (Dp), Dv/Dp was 1.15 and degree of circularity was 0.98. Furthermore, external additives were adjusted and mixed in order to provide appropriate flowability, transfer property and charging ability to obtain toner L.

| Preparation of Toner M | |
|---|---|
| Crystalline polyester resin A | 15 parts by mass |
| Non-crystalline polyester resin (by Kao Corp. Tg: 63.6° C., Tm: 106.1° C.) | 35 parts by mass |
| Non-crystalline polyester resin (by Kao Corp. Tg: 59.8° C., Tm: 149.2° C.) | 40 parts by mass |
| Anti-free fatty acid carnauba wax (glass transition temperature: 83° C.) | 5 parts by mass |
| Carbon black (#44 by Mitsubishi Chemical Corp.) | 10 parts by mass |

The above constituent material of toner was kneaded by means of a two-axis extrusion apparatus after stir-mixing in a Henschel mixer sufficiently and pulverized, classified after cooling to obtain a toner base particle M having a weight average particle diameter of 6.5 μm, a ratio of volume average particle diameter (Dv) to number average particle diameter (Dp), Dv/Dp of 1.25 and degree of circularity of 0.91. The temperature of the kneading machine was set at minimum of the range where the kneaded material is melted so as for the temperature of the kneaded material to be 120° C. at the outlet of the kneading machine.

External additives were adjusted and further mixed for providing appropriate flowability, transfer property and charging ability to obtain a toner M.

The glass transition temperature Tg, melting temperature Tm, molecular weight peak, content of components having a molecular weight of 3,000 or more and a ratio of weight average molecular weight to number average molecular weight, Mw/Mn of each toner A to M are shown in Table 3.

TABLE 3

| | Tg (° C.) | Tm (° C.) | Molecular Weight Peak | Molecular Weight Components of 30,000 or more | Mw/Mn |
|---|---|---|---|---|---|
| Polyester Resin A | 68.6 | 106.1 | 8,900 | 0% | 4.5 |
| Polyester Resin B | 75.9 | 107.8 | 14,000 | 0% | 2.0 |
| Polyester Resin C | 65.2 | 106.2 | 8,300 | 2% | 9.8 |
| Polyester Resin D | 62.5 | 140.8 | 21,000 | 20% | 11.6 |
| Polyester Resin E | 68.6 | 106.1 | 8,900 | 0% | 4.5 |
| Polyester Resin F | 75.9 | 107.8 | 14,000 | 0% | 2.0 |
| Polyester Resin G | 65.2 | 106.2 | 8,300 | 2% | 9.8 |
| Polyester Resin H | 62.5 | 140.8 | 21,000 | 20% | 11.6 |
| Polyester Resin I | 56.3 | 92.8 | 5,600 | 0% | 4.2 |
| Polyester Resin J | 58.1 | 96.4 | 5,600 | 0% | 4.8 |
| Polyester Resin K | 59.2 | 110.2 | 11,000 | 0% | 4.5 |
| Polyester Resin L | 58.3 | 140.2 | 5,600 | 8% | 11.4 |
| Polyester Resin M | 49.3 | 125.6 | 5,800 | 5% | 9.6 |

A tandem color copier composition based on the above-mentioned composition as shown in FIG. 3 was used as the image forming apparatus in Examples.

The transfer fixing conditions of the transfer fixing device used in the above image forming apparatus were set as follow.

Condition 1: transfer fixing nip time: 8 ms, temperature of the member: melting temperature of toner Tmt+50° C.

Condition 2: transfer fixing nip time: 25 ms, temperature of the member: melting temperature of toner Tmt+10° C.

Condition 3: transfer fixing nip time: 30 ms, temperature of the member: melting temperature of toner Tmt+10° C.

Condition 4: transfer fixing nip time: 40 ms, temperature of the member: melting temperature of toner Tmt+10° C.

The nip pressure was set at 0.5 MPa so as for the transfer fixing member to be attached firmly to the recording medium sufficiently.

The evaluation on the transfer fixing property of the toners A to M in a solid image of 0.6 mg/cm$^2$ attachment amount and a 2×2 dot image (600 dpi; 25%) was conducted. A regular paper 600-70W by Ricoh Company, Ltd. was used as the recording medium and dot reproducibility on the recording medium was evaluated with ΔID ($ID_{max}$-$ID_{min}$) and observation of 2×2 dot image with eyes. When ΔID was less than 0.005, it was evaluated as A as an accepted range, when ΔID was 0.005 or more and 0.008 or less, it was evaluated as B, and when ΔID was more than 0.008, it was evaluated as C as the evaluation criteria for ΔID. And when it is determined that an image was reproduced faithfully, dot reproducibility on the recording medium was marked as A, when there were problems of nonuniformity, absence of dots, etc., it was marked as C and when reproducibility was deficient but nonuniformity and absence of dots were not observed, it was marked as B. The results are shown in Table 4.

TABLE 4

| | | Condition 1 | | Condition 2 | | Condition 3 | | Condition 4 | |
|---|---|---|---|---|---|---|---|---|---|
| | | ΔID | Visual | ΔID | Visual | ΔID | Visual | ΔID | Visual |
| Ex. 1 | Toner A | A | A | A | A | A | A | C | B |
| Ex. 2 | Toner B | A | A | A | A | A | A | B | B |
| Comp. Ex. 1 | Toner C | C | C | B | C | B | C | A | A |
| Comp. Ex. 2 | Toner D | C | C | C | C | C | C | B | B |
| Ex. 3 | Toner E | A | A | A | A | A | A | C | B |
| Ex. 4 | Toner F | A | A | A | A | A | A | B | B |
| Comp. Ex. 3 | Toner G | C | C | C | C | B | C | A | A |
| Comp. Ex. 4 | Toner H | C | C | C | C | C | C | B | B |
| Ex. 5 | Toner I | A | A | A | A | A | A | C | C |
| Ex. 6 | Toner J | A | A | A | A | A | A | C | C |
| Ex. 7 | Toner K | A | A | A | A | A | A | B | B |
| Comp. Ex. 5 | Toner L | C | C | C | C | C | C | B | B |
| Comp. Ex. 6 | Toner M | C | C | B | C | B | B | A | A |

The evaluation results of ΔID and dot reproducibility of the toner in Examples A, B, E, F, I, J and K were appropriate with conditions 1 to 3, however, reproducibility was degraded with condition 4 because of the occurrence of hot offset in the solid image and thickened dot image. The results of evaluation on ΔID and dot reproducibility of the toner in Comparative Examples C, D, G, H, L and M shows degradation of ΔID and dot reproducibility with conditions 1 to 3 because of fixing defects, however, ΔID and dot reproducibility with condition 4 were better because of sufficient nip time in condition 4.

Evaluation of toners A, B, E, H, I, J and K which exhibited appropriate results in the former evaluation was further conducted by using the conventional fixing device with a composition as shown in FIG. 2. As a result, fixing defects occurred for the all toners because toner was not heated satisfactorily in condition 5. Moreover, appropriate fixing property of the toners was obtained in condition 6, however, hot offset was observed in condition 7.

Condition 5: 2×2 dot image (600 dpi; 25%) was fixed with a fixing nip time of 8 ms and a temperature of the member of toner being melting temperature Tmt+50° C.

Condition 6: solid image with an attachment amount of 0.6 mg/cm$^2$ was fixed with a fixing nip time of 30 ms and a temperature of the member of toner being melting temperature Tmt+30° C.

Condition 7: solid image with an attachment amount of 0.6 mg/cm$^2$ was fixed with a fixing nip time of 30 ms and a temperature of the member of toner being melting temperature Tmt+50° C.

What is claimed is:

1. An image forming apparatus, comprising:

an image bearing member;

a latent electrostatic image forming unit configured to form a latent electrostatic image on the image bearing member;

a developing unit configured to develop the latent electrostatic image by using a toner to form a toner image;

a transfer fixing member configured to bear the toner image;

a heating unit configured to heat the toner image on the transfer fixing member; and a pressurizing member configured to form a transfer fixing nip with the transfer fixing member, wherein the toner image on the transfer fixing member is transferred and fixed simultaneously to a recording medium which passes through the transfer fixing nip to record an image on the recording medium, a nip time, which is the time it takes for the recording medium to pass through the transfer fixing nip is 30 ms or less, the toner comprises at least a binder and the binder comprises a main peak in an area of 5,000 to 15,000 molecular weight in a molecular weight distribution measured by GPC, a content of the component of a 30,000 or more molecular weight is 0.05% or less and a value of weight-average molecular weight (Mw)/number average molecular weight (Mn), Mw/Mn is 2 to 6.

2. The image forming apparatus according to claim 1, wherein the transfer fixing member is roll shaped, and the toner image formed on the image bearing member is transferred primarily to an intermediate transfer member, the toner image on the intermediate transfer member is transferred secondarily to the transfer fixing member and the toner image on the transfer fixing member is transferred tertiarily to the recording medium.

3. The image forming apparatus according to claim 1, wherein the transfer fixing member is belt shaped, and the toner image formed on the image bearing member is transferred primarily to an intermediate transfer member, the toner image on the intermediate transfer member is transferred secondarily to the transfer fixing member and the toner image on the transfer fixing member is transferred tertiarily to the recording medium.

4. The image forming apparatus according to claim 1, wherein the transfer fixing member is an intermediate transfer member, and the toner image formed on the image bearing member is transferred primarily to the transfer fixing member and the toner image on the transfer fixing member is transferred secondarily to the recording medium.

5. The image forming apparatus according to claim 1, wherein the binder comprises a main peak in an area of 8,000 to 12,000 molecular weight in a molecular weight distribution measured by GPC, and does not comprise the component of 30,000 or more molecular weight and a value of weight-average molecular weight (Mw)/number average molecular weight (Mn), Mw/Mn is 2 to 5.

6. The image forming apparatus according to claim 1, wherein the binder comprises at least a polyester resin.

7. The image forming apparatus according to claim 1, wherein $$Tmt+10^\circ\ C. \leqq T1 \leqq Tmt+50^\circ\ C.$$

is true when a melting temperature of the toner (Tmt) is 80° C. to 140° C. and a surface temperature of the transfer fixing member is represented by T1.

8. The image forming apparatus according to claim 1, wherein a glass transition temperature of the toner (Tgt) is 50° C. to 80° C.

9. The image forming apparatus according to claim 1, wherein an acid value of the toner is 30 mgKOH/g to 50 mgKOH/g.

10. The image forming apparatus according to claim 1, wherein $$Tgt<Tw<Tmt$$

is satisfied when the toner comprises 5% by mass to 40% by mass of a releasing agent and a melting point of the releasing agent is represented by Tw; Tgt represents a glass transition temperature of the toner and Tmt represents a melting temperature of the toner.

11. The image forming apparatus according to claim 1, wherein a volume average particle diameter of the toner (Dv) is 3 μm to 10 μm, a ratio of volume average particle diameter (Dv) to number average particle diameter (Dp), Dv/Dp is 1.05 to 1.25 and an average degree of circularity is 0.90 to 1.00.

12. The image forming apparatus according to claim 1, wherein the toner comprises a plasticizer of a resin which is compatible with the resin when heated.

13. The image forming apparatus according to claim 12, wherein the toner is granulated after preparing an emulsified and/or dispersion liquid by emulsifying and/or dispersing a solution and/or dispersion liquid of toner material in an aqueous medium.

14. The image forming apparatus according to claim 1, wherein the toner comprises a crystalline polyester resin which is compatible with a resin when heated.

15. The image forming apparatus according to claim 1, wherein the toner is granulated by spraying a solution and/or dispersion liquid of toner material.

16. An image forming method, comprising:

forming a latent electrostatic image on an image bearing member;

developing the latent electrostatic image by using a toner to form a toner image; and transfer fixing using a transfer fixing member configured to bear the toner image, a heating unit configured to heat the toner image on the transfer fixing member and a pressurizing member configured to form a transfer fixing nip with the transfer fixing member, wherein the toner image on the transfer fixing member is transferred and fixed simultaneously to a recording medium which passes through the transfer fixing nip to record an image on the recording medium, a nip time, the time it takes for the recording medium to pass through the transfer fixing nip is 30 ms or less, and the toner comprises at least a binder and the binder comprises a main peak in an area of 5,000 to 15,000 molecular weight in a molecular weight distribution measured by GPC, and a component of 30,000 or more molecular weight is 0.05% or less and a value of weight-average molecular weight (Mw)/number average molecular weight (Mn), Mw/Mn is 2 to 6.

17. The image forming method according to claim 16, wherein the binder comprises a main peak in an area of 8,000 to 12,000 molecular weight in a molecular weight distribution measured by GPC, and does not comprise the component of 30,000 or more molecular weight and a value of weight-average molecular weight (Mw) / number average molecular weight (Mn), Mw/Mn is 2 to 5.

18. The image forming method according to claim 16, wherein the binder comprises at least a polyester resin.

19. The image forming method according to claim 16, wherein a volume average particle diameter of the toner (Dv) is 3 μm to 10 μm, a ratio of volume average particle diameter (Dv) to number average particle diameter (Dp), Dv/Dp is 1.05 to 1.25 and an average degree of circularity is 0.90 to 1.00.

* * * * *